United States Patent [19]

Ueda et al.

[11] 4,417,700

[45] Nov. 29, 1983

[54] APPARATUS FOR WINDING A PLURALITY OF YARNS AND A METHOD FOR CHANGING BOBBINS IN THE APPARATUS

[75] Inventors: Hiroshi Ueda; Katsumi Hasegawa; Masazumi Imae, all of Otsu, Japan

[73] Assignee: Toray Industries, Inc., Tokyo, Japan

[21] Appl. No.: 318,574

[22] Filed: Nov. 5, 1981

[30] Foreign Application Priority Data

Nov. 7, 1980 [JP] Japan ..... 55-155844

[51] Int. Cl.[3] ..... B65H 54/02; B65H 67/04

[52] U.S. Cl. ..... 242/18 A; 242/18 R; 242/18 PW; 242/43 R; 242/43.1

[58] Field of Search ..... 242/18 A, 18 R, 18 PW, 242/26.1, 26.2, 26.3, 35.5 R, 43 R, 43.1, 158 R, 158 F, 158.4 R

[56] References Cited

U.S. PATENT DOCUMENTS

| | | | |
|---|---|---|---|
| 1,067,534 | 7/1913 | Manquat | 242/18 A X |
| 2,304,097 | 12/1942 | Jackson | 242/18 A |
| 3,550,871 | 12/1970 | Keith | 242/18 A |
| 3,625,442 | 12/1971 | DiMeglio | 242/18 A |
| 3,688,998 | 9/1972 | Carr et al. | 242/18 A |
| 3,695,521 | 10/1972 | Torii et al. | 242/18 A |
| 3,865,321 | 2/1975 | Miller | 242/18 A |
| 4,099,680 | 7/1978 | Miller | 242/18 A |
| 4,166,587 | 9/1979 | Miller | 242/18 A |
| 4,186,890 | 2/1980 | Miller | 242/18 A |

FOREIGN PATENT DOCUMENTS

| | | | |
|---|---|---|---|
| 2657545 | 6/1978 | Fed. Rep. of Germany | 242/18 A |
| 45-34420 | 11/1970 | Japan | 242/18 A |
| 1132754 | 11/1968 | United Kingdom | 242/18 A |

*Primary Examiner*—Stanley N. Gilreath
*Attorney, Agent, or Firm*—Austin R. Miller

[57] ABSTRACT

An apparatus for winding a plurality of yarns comprises:

a pair of spindle frames independently and horizontally movable along parallel passages;

each of the spindle frames having a plurality of rotatable spindles horizontally projecting therefrom, which are vertically superposed and which are axially displaced by a predetermined length from the top spindle to the bottom spindle;

a threading arm frame disposed at the center of the spindle frames and having threading arms pivotally mounted thereon, the number of the threading arms being the same as that of the spindles mounted on each spindle frame, and the threading arms are axially displaced by the predetermined length from the top arm to the bottom arm; and induction motors connected to the rotatable spindles, respectively.

19 Claims, 90 Drawing Figures

Y
131
51
53
54
VIII

Y
54
53
51
153
161
15
25
T

T
Y
153
54
161
25
15
53
51

Y
15
25
51
53
54
153
161

153
161
15
25
54
51
53
Y

201
No
203
203a
203b
203c
203d
204
202
INITIAL ROTATIONAL SPEED PRESETTING CIRCUIT
209
YARN PASSAGE DETECTOR
inh
C
P.CTR
Q
OSC
-Ro
Vf
Ci
1/fo
∝ 1/N ∝R
ΔR
f(ΔR)

201
INITIAL ROTATIONAL SPEED PRESETTING CIRCUIT
No
202
SPINDLE ROTATIONAL SPEED DETECTOR
N
CALCULATING CIRCUIT
203
ΔR
FUNCTION GENERATOR
204
209
YARN PASSAGE DETECTOR
234
TRAVERSE DETECTOR

201
INITIAL ROTATIONAL SPEED PRESETTING CIRCUIT
No
203
YARN LAYER CALCULATING CIRCUIT
ΔR
204
FUNCTION GENERATOR
202
SPINDLE ROTATIONAL SPEED DETECTOR
N
209
YARN PASSAGE DETECTOR
234
TRAVERSE DETECTOR

APPARATUS FOR WINDING A PLURALITY OF YARNS AND A METHOD FOR CHANGING BOBBINS IN THE APPARATUS

FIELD OF THE INVENTION

The present invention relates to an apparatus for winding a plurality of yarns into yarn packages, especially pirns, and a method for changing bobbins in the apparatus. More specifically, the present invention relates to an apparatus for continuously winding a plurality of yarns which have a plurality of pairs of spindles and the plurality of threading arms disposed between the paired spindles and by which a plurality of yarns are alternately changed and continuously wound by means of a plurality of paired spindles without causing any yarn breakage.

BACKGROUND OF THE INVENTION

It is conventionally known that a yarn is wound onto one of two spindles parallelly installed in a winding apparatus to form a package on a bobbin inserted on the spindle and that, when a full package is completed, the yarn is changed to the other spindle. Due to the above-described method, a yarn can be continuously wound onto bobbins without causing interruption in the winding of the yarn, and as a result, operational efficiency can remarkably be increased. In this winding method, it is very important that the yarn change from one spindle to the other spindle when a full package is completed be ensured. In this case, if the success ratio of the bobbin change is low, the advantages created by the above-described continuous winding method are reduced.

Japanese Patent Publication No. 34420/70 discloses that in order to increase the success ratio of the bobbin change, a specially designed yarn threading device enclose each spindle so as to guide a yarn around the spindle. However, such a yarn threading device is excessively large and does not comply with the requirement for saving space.

A device has been proposed in Japanese Patent Application Laid-open No. 93141/79 by which the above-described specially designed yarn threading device can be omitted and in which a traverse device is simplified, and as a result, the size of the obtained device is minimized. More specifically, in this prior art device, a yarn guide is swingably disposed at the front end of a swingable arm, and the arm is tilted toward a spindle to which the yarn passage is changed, so that a yarn guided by the yarn guide disposed at the front end of the arm comes into contact with the empty bobbin. As a result, a yarn is caught by the yarn threading portion formed at the position adjacent to the end of the empty bobbin while the yarn is axially moved onto the empty bobbin.

According to the proposal in Japanese Patent Application Laid-open No. 93141/79, the compactness of the construction in the yarn winding apparatus can be achieved, however, the success ratio of the bobbin change becomes low because of the following reasons. In this prior art device, a traverse device which can effect usual traverse motion is utilized to perform a threading operation. Accordingly, the traverse device described in this prior art is required to function so that a yarn is uniformly distributed around the bobbin by means of the traverse motion. In short, in this prior art device, the traverse motion remains while the bobbin change operation is effected. Accordingly, the yarn must necessarily be in contact with the bobbin and axially be moved for a short time before it is caught by the yarn threading portion located adjacent to the bobbin end. When a yarn is moved while it is still in contact with the bobbin, as described above, the tension in the yarn becomes unsteady, and the yarn may not be caught by means of the yarn threading portion.

SUMMARY OF THE INVENTION

An object of the present invention is to provide a yarn winding apparatus by which the above-described disadvantages can be eliminated and in which a traverse device is also utilized as a yarn changing device so that the apparatus can be compact.

Another object of the present invention is to provide a yarn winding apparatus by which the success ratio of the bobbin change can be increased.

A further object of the present invention is to provide a method for changing bobbins utilizing the above-described yarn winding apparatus of the present invention.

According to one aspect of the present invention, an apparatus for winding a plurality of yarns is provided which comprises:

a pair of spindle frames independently and horizontally movable along parallel passages;

each of the spindle frames having a plurality of rotatable spindles horizontally projecting therefrom, which are vertically superposed and which are axially displaced by a predetermined length from the top spindle to the bottom spindle;

a threading arm frame disposed between the spindle frames and having threading arms pivotally mounted thereon, the number of the threading arms being the same as that of said spindles mounted on each spindle frame, and the threading arms are axially displaced by the predetermined length from the top arm to the bottom arm; and electric motors connected to said rotatable spindles, respectively.

According to another aspect of the present invention a method for continuously winding a yarn in a yarn winding apparatus is provided which comprises: two spindles rotatably and axially slidably disposed in parallel with each other; and a threading arm disposed between the two spindles so as to be axially movable and having a yarn guide swingable in a plane perpendicular to the spindles, wherein a yarn is fed to one of the spindles to be wound thereon while the arm is axially traversed to and fro, and when the package is completed on the spindle, the arm is swung toward an empty bobbin inserted onto the other spindle so as to change the winding bobbin, which method comprises:

A. when the bobbins are changed, the spindle with the empty bobbin is moved from a standby position to a threading position wherein the yarn threading portion of the spindle is exposed to a range wherein the yarn is traversed to and fro to form the full bobbin;

B. then, the traverse motion of the arm is stopped so as to cause said thread guide mounted on the arm to correspond to the yarn threading portion, and the spindle having the full bobbin commences to move axially;

C. the arm is then swing toward the yarn threading portion of the spindle with the empty bobbin so as to thread the yarn guided by the yarn guide onto the yarn threading portion; and D. thereafter, the arm commences its traverse motion, and it is returned to its normal traversing position, and after the threading operation is completed, the spindle with the empty bobbin is returned to its normal winding position.

A method for continuously winding a yarn in a yarn winding apparatus is also provided which comprises two spindles rotatably and axially slidably disposed in parallel with each other; and a threading arm disposed between the two spindles and having a yarn guide swingable in a plane perpendicular to the spindles, wherein a yarn is fed to one of the spindles to be wound thereon while the spindle is axially traversed to and fro relative to the arm, and when the package is completed on the spindle, the arm is swung toward an empty bobbin inserted onto the other spindle so as to change the winding bobbin, which method comprises:

A. when the bobbins are changed, the spindle with the empty bobbin is moved from a normal winding position to a threading position wherein the yarn guide mounted on the top of the arm corresponds to the yarn threading portion of said spindle and is stopped there, and the spindle with a full package continues its traverse motion;

B. then the arm is swung toward the threading portion formed on the spindle with the empty bobbin, and the yarn guided by the yarn guide formed at the top of the arm is threaded onto the threading portion; and C. thereafter, the traverse motion of the spindle with the empty bobbin is commenced, and the arm is returned to the original position.

BRIEF DESCRIPTION OF THE DRAWINGS

Some embodiments of the present invention will now be explained in detail with reference to the accompanying drawings wherein:

FIGS. 43, 43A and 43B are flow diagrams for controlling traverse motion;

DETAILED DESCRIPTION OF THE INVENTION

Figure 1:
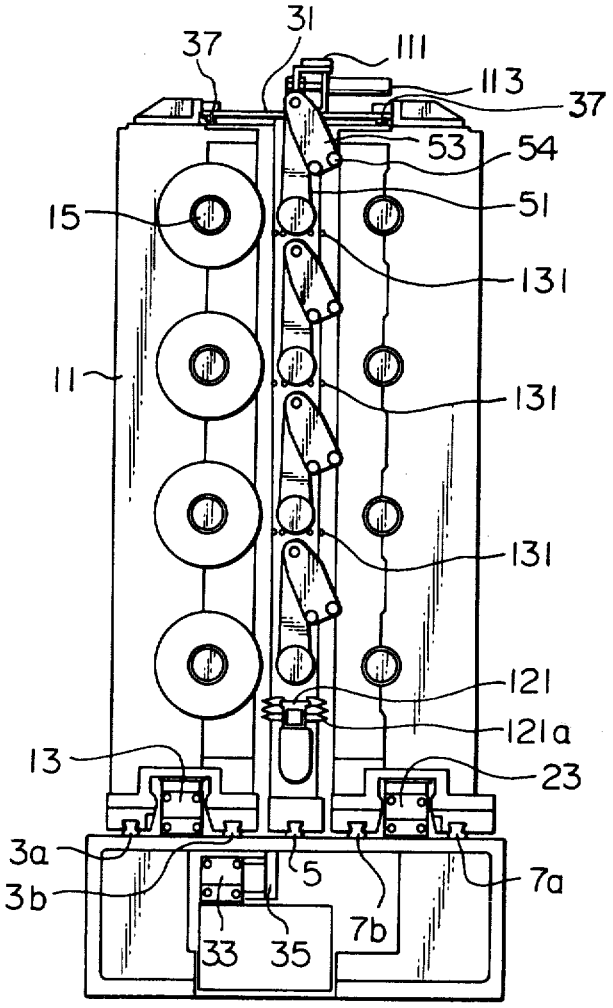
FIG. 1 is an elevational view of a yarn winding apparatus according to the present invention.
Figure 2:
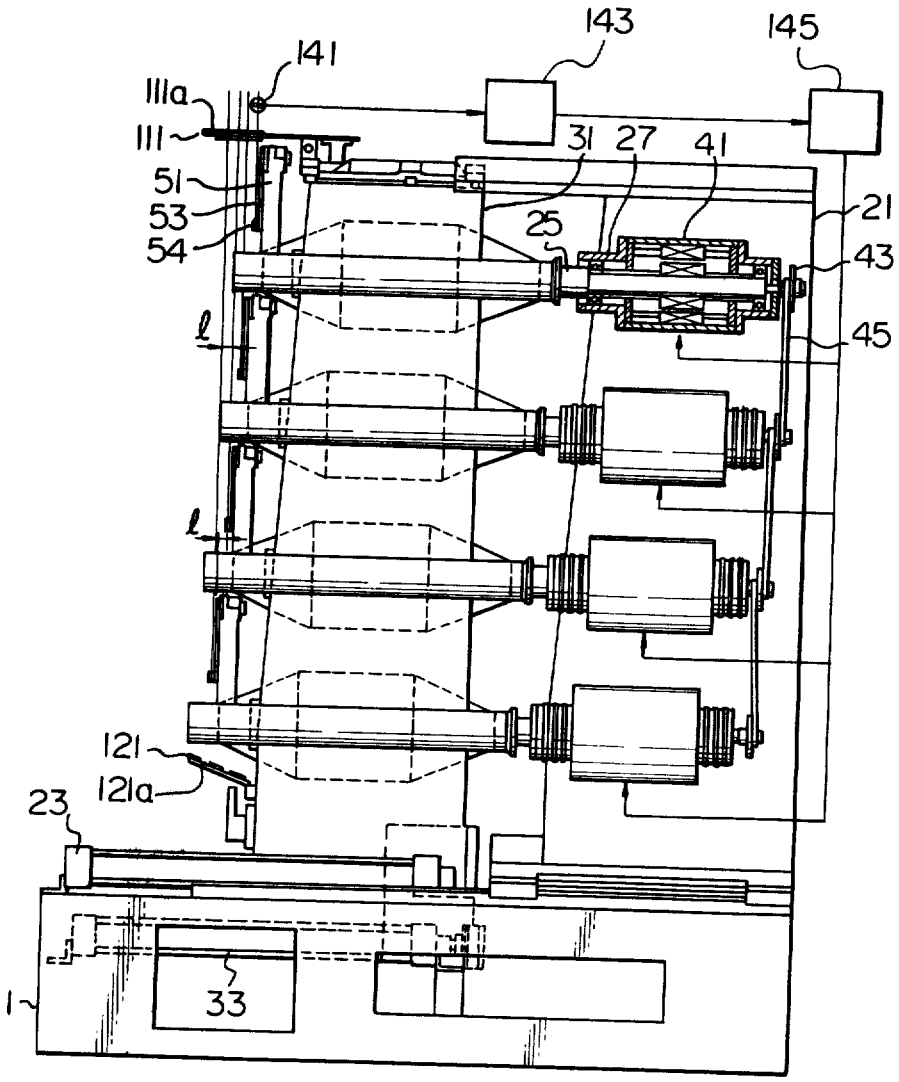
FIG. 2 is a side view of FIG. 1.

Referring to FIGS. 1 and 2, a base machine frame 1 of an apparatus for winding a plurality of yarns according to the present invention is formed in a box shape and has five rails *3a*, *3b*, 5, *7a* and *7b* extending perpendicular to the sheet on which FIG. 1 is illustrated. The pair of rails *3a* and *3b* guide a left spindle frame 11, and similarly the pair of rails *7a* and *7b* guide a right spindle frame 21. The central rail 5 guides a threading arm frame 31. Since the left and right spindle frames 11 and 21 have constructions symmetric with each other, only the construction of the right spindle frame 21 will now be explained.

The right spindle frame 21 is slidably mounted on the pair of rails *7a* and *7b* by means of a well known slide bearing (not shown) and is connected to the front end of a piston rod (not shown) of a hydraulic cylinder 23 disposed on the base machine frame 1 so that the spindle frame 21 can be moved to and fro along the rails *7a* and *7b*. The spindle frame 21 has four spindles 25 which are vertically superposed and which are rotatably supported by radial bearings 27 (FIG. 2). In FIG. 2, the spindles 25 are axially displaced by a predetermined length l from the top spindle to the bottom spindle. The respective right ends of the spindles 25 are connected to the shafts of electric motors, for example induction motors 41, of which the sizes and the characteristics thereof are substantially the same. Pulleys 43 are attached to the right ends of the shaft of the induction motors 41 and timing belts 45 are mounted between the adjacent pulleys 43. As a result of the above-described construction, the spindle frame 21 can be moved to and fro along the rails *7a* and *7b* by means of the hydraulic cylinder 23. Although their construction is very simple, the spindles 25 disposed on the spindle frame 21 can be rotated by means of the induction motors 41, the rotational speeds of which are synchronized with each other by means of the timing belts 45. The control for adjusting the rotational speed of the induction motors will be explained later.

The threading arm frame 31 in this embodiment is slidably mounted on the central rail 5 by means of a well known slide bearing (not shown) and is connected to the front end of a piston rod (not shown) of a hydraulic cylinder 33 disposed within the base machine frame 1 via a connecting bracket 35 (FIG. 1) so that the threading arm frame 31 can be moved to and fro along the central rail 5. In addition to the central rail 5, a pair of upper rails 37, which are illustrated in only FIG. 1, are mounted on the tops of the spindle frames 11 and 21 in order to support the upper portion of the threading arm frame 31 being slidable relative thereto, by means of similarly well known slide bearings (not shown). In another embodiment which is not shown, the threading arm frame is fixed on the base machine frame. The threading arm frame 31 has four threading arms 51 pivotably mounted thereon and vertically superposed. The threading arms 51 have yarn guides 53 pivotably mounted thereon and are axially displaced by the above-described predetermined length l between the adjacent threading arm from the top arm to the bottom arm.

Figure 3:
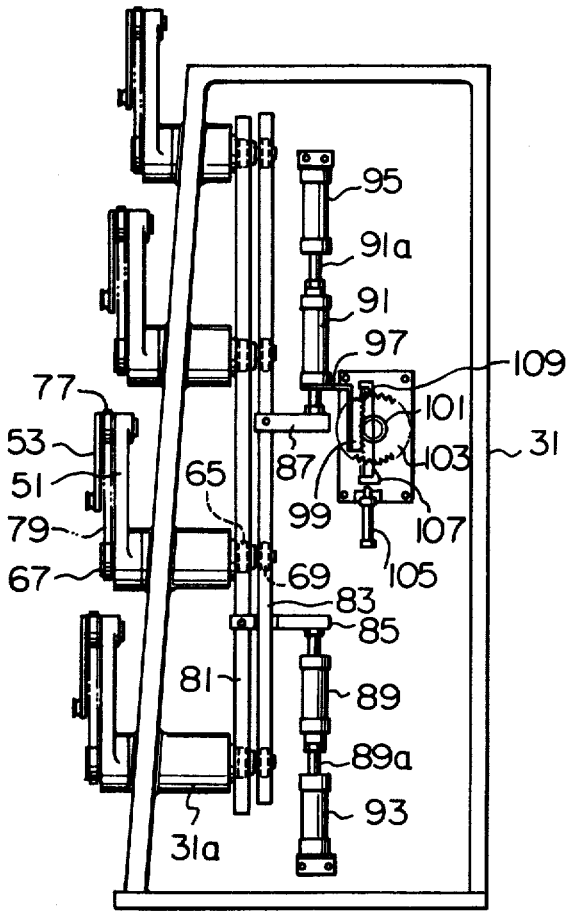
FIG. 3 is a side view of a threading arm frame with a mechanism for actuating arms installed in the apparatus of FIGS. 1 and 2 wherein a side cover is removed so as to clarify the illustration.
Figure 4:
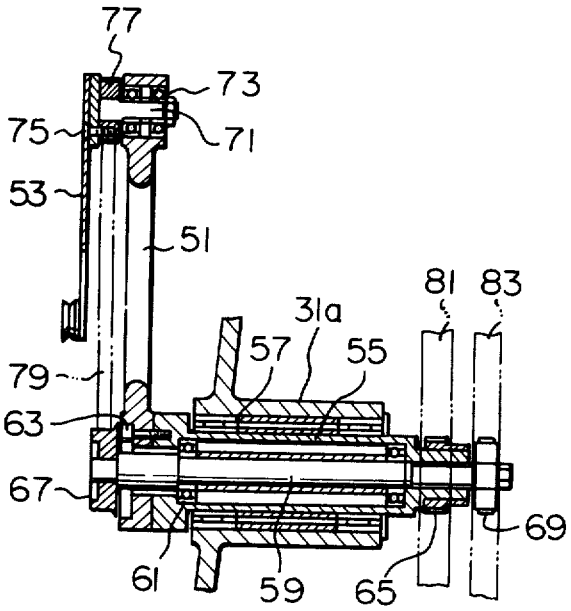
FIG. 4 is a cross sectional side view of a part of the mechanism illustrated in FIG. 3.

Referring to FIGS. 3 and 4, the actuating mechanisms of the threading arm and the yarn guide 53 will now be explained. The threading arm frame 31 has four hollow and cylindrical bosses 31*a*. As clearly illustrated in FIG. 4, a hollow tube 55 is rotatably supported by a pair of journal bearings 57 and also has a shaft 59 extending therethrough and rotatably supported therein by means of a pair of journal bearings 61. The left end of the hollow tube 55 is secured to the lower end of the threading arm 51 by means of machine screws 63. The right end of the hollow tube 55 has a pinion 65 fixed thereon. The left end of the shaft 59 has a sprocket 67 fixed thereon, and the right end of the shaft 59 has a pinion 69 fixed thereon. The front end of the threading arm 51 has a pin 71 rotatably mounted therein by means of a pair of bearings 73. The yarn guide 53 is secured to the pin 71 together with a sprocket 77 by means of machine screws 75. A timing belt 79 is engaged with the sprockets 67 and 77. The pinions 65 and 69 fixed on the right ends of the hollow tube 55 and the shaft 59, respectively, engage with racks 81 and 83, respectively, which extend vertically, respectively, as illustrated in FIG. 3. The racks 81 and 83 have brackets 85 and 87, attached thereto, respectively, which are connected to ends of pneumatic cylinders 89 and 91, respectively. The piston rods 89*a* and 91*a* of the pneumatic cylinders 89 and 91 also serve as piston rods of pneumatic cylinders 93 and 95, ends of which are secured to the threading arm frame 31 by means of brackets (not shown).

As a result of the above-explained construction, the threading arm 51 is actuated by the pneumatic cylinders 89 and 93, through the rack 81, pinion 65 and the hollow tubes as follows. When both the pneumatic cylinders 89 and 93 are retracted, the threading arm 51 stops at position $R_1$ illustrated in FIG. 5. While the pneumatic cylinder 93 is being extended and the other pneumatic cylinder 89 is being retracted, the threading arm 51 stops at the central position N in FIG. 5. When both the pneumatic cylinders 89 and 93 are extended, the threading arm 51 stops at position $L_1$ in FIG. 5. Similarly, the yarn guide 53 is actuated by the pneumatic cylinders 91 and 95, through the rack 83, the pinion 69, the shaft 59, the sprockets 67 and 77 and the timing belt 79, as follows. When both the pneumatic cylinders 91 and 95 are retracted, the yarn guide 53 stops at position $R_2$ in FIG. 5. When the pneumatic cylinder 95 is retracted and the pneumatic cylinder 91 is extended, the yarn guide 53 stops at position $L_2$ in FIG. 5.

Figure 5:
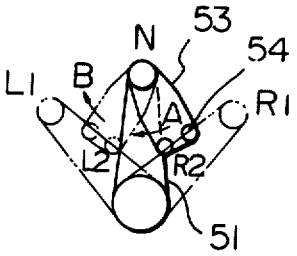
FIG. 5 is an elevational view illustrating the operation of the arm and the yarn guide illustrated in FIG. 4.

Referring to FIG. 5, the pneumatic cylinder 91 has a bracket 97 for supporting a control rack 99 which meshes with a pinion 101 coaxially fixed to a ratchet wheel 103. A small pneumatic cylinder 105 is secured to the threading arm frame 31 and has a pair of pawls 107 and 109, alternately engaging with the ratchet formed on the ratchet wheel 103.

After the yarn guide 53 locates at position $R_2$, air is supplied to the the pneumatic cylinder 105 so that the piston rod 91*a* has a tendency to extend. Then, the small pneumatic cylinder 105 is reciprocally moved as a package is formed on the bobbin held onto the spindle 25, as will be described later, and accordingly, the ratchet wheel 103 together with the pinion 101 is stepwisely rotated, and correspondingly the control rack 99 is also stepwisely moved. As a result, the yarn guide 53 is gradually moved in a direction denoted by arrow A in FIG. 5, as the amount of the package increases. Similarly, the yarn guide 53 is gradually moved in a direction denoted by arrow B in FIG. 5, as the package is formed on the bobbin held onto the spindle 15.

Figure 8:
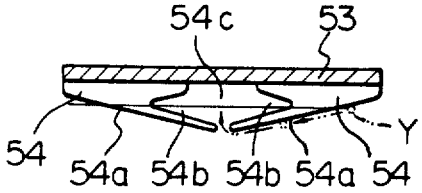
FIG. 8 is a cross sectional view taken along line VIII—VIII in FIG. 7 (A)

In FIG. 8, the yarn guide 53 has a pair of guide elements 54 formed in a triangular shape which has an inclined surface 54*a* and a recess 54*b* formed on the side thereof. The recesses 54*b* of the triangular shaped guide elements are facing each other so as to form a yarn holding space 54*c*.

The threading arm frame 31 has a yarn passage guide 111 which is disposed at the upper surface thereof and which is moved by means of a pneumatic cylinder 113 in a direction parallel to the sheet on which FIG. 1 is illustrated. The yarn passage guide 111 has four guide eyes 111*a*, the distance between the adjacent guide eyes 111*a* being equal to the above-described predetermined distance l.

The threading arm frame 31 further has a yarn holding guide 121 projecting therefrom at a position beneath the bottom threading arm 51. The yarn holding guide 121 has four guide elements 121*a*, the distance between the adjacent guide elements 121*a* being equal to the above-described predetermined distance l.

Figure 11:
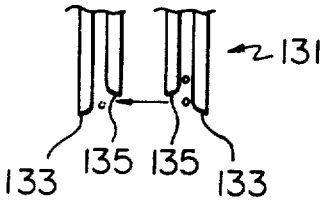
FIG. 11 is a plan view of a yarn passage restricting guide.

The threading arm frame 31 also has three sets of guides 131 for restricting yarn passage which guides are disposed between vertically adjacent threading arms 51. As illustrated in FIG. 11, each yarn passage restricting guide 131 comprises a pair of long guides 133 located near the spindle frames 15 and 25 and a pair of short guides 135 located between the pair of long guides 133.

Figure 10:
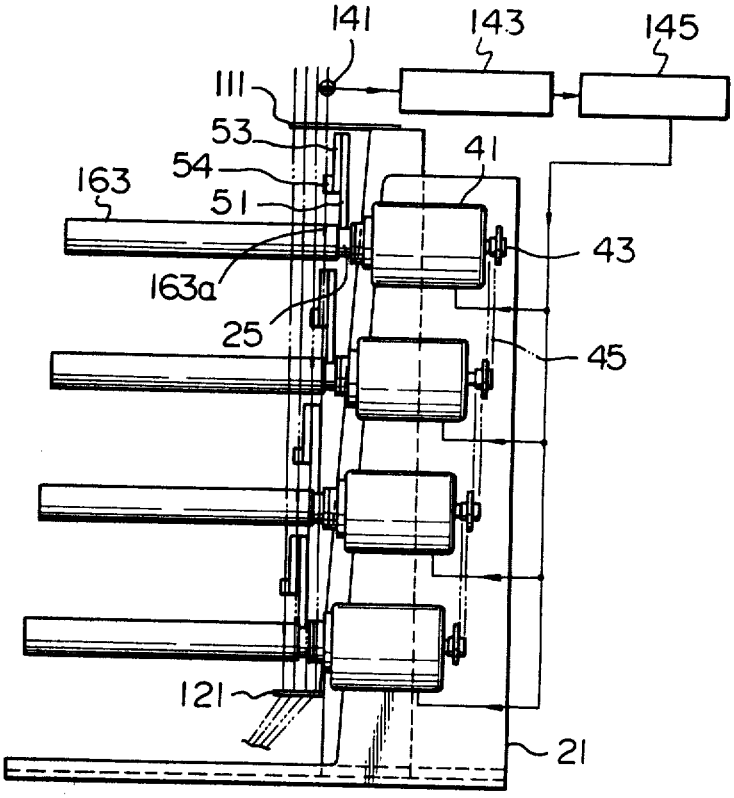
FIG. 10 is a side view of FIG. 9.

As illustrated in FIGS. 2 and 10, a detector 141 of a conventionally known type is disposed on a yarn passage so as to detect tension in a yarn to be wound. The output of the tension detector 141 is connected to a control 143 which controls the rotational speeds of the previously described induction motors 41 via an invertor 145 in a conventionally known manner in accordance with the changes in the detected tension in the yarn. This control system can economize the cost of the equipment because the construction is very simple. This control system is disclosed in detail in U.S. Pat. No. 3,931,938, No. 4,182,167 and No. 4,245,794.

Figure 39:
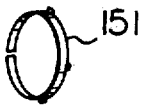
FIG. 39 is a perspective view of an annular holding plate used in the yarn threading portion illustrated in FIGS. 36 and 37.
Figure 40A:
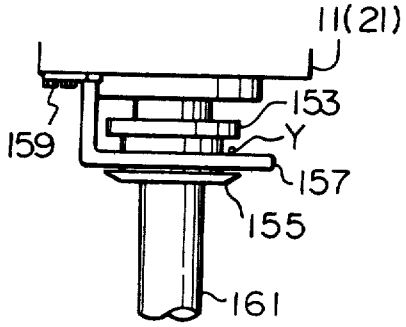
FIGS. 40 (A) through 40 (C) are plan views sequentially illustrating yarn threading operations onto the yarn threading portion illustrated in FIGS. 36 and 37.
Figure 40B:
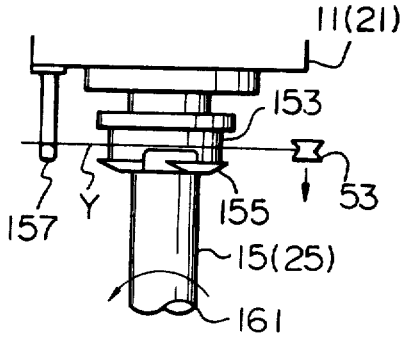
Figure 40C:
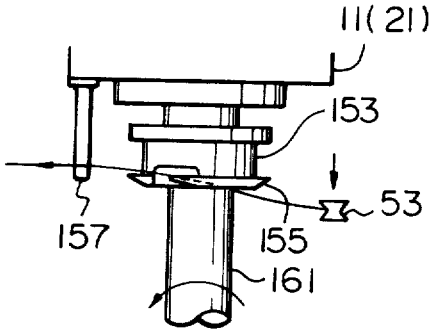
Figure 41:
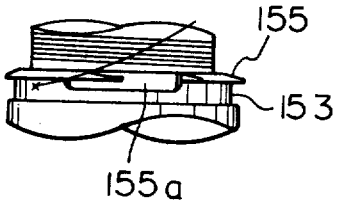
FIG. 41 is an elevational view of the yarn threading portion where a yarn is caught.
Figure 42:
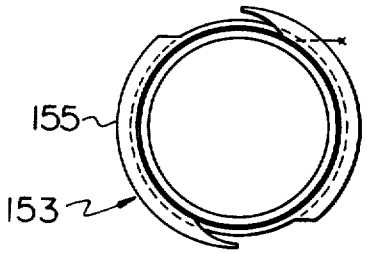
FIG. 42 is a plan view of FIG. 41.

Referring to FIGS. 36 through 39, a yarn threading portion formed at the base portion of the spindle 15 or 25 will now be explained. A holding plate 151, made of a thin metallic plate, has an annular shape, as illustrated in FIG. 39, and is inserted onto the spindle 15 or 25. A catch ring 153 has a tubular shape, the inner diameter of which is slightly larger than the outer diameter of the annular holding plate 151 and has a flange 155 extending outwards from one end thereof. The flange 155 has two notches **155*a* and two hooks 155*b* formed at the trailing sides of the notches 155*a* and projecting toward the leading sides thereof. The catch ring 153 is inserted onto the annular holding plate 151 which is inserted onto the spindle 15 or 25. When the spindle 15 or 25 rotates, the annular holding plate 151 is pressed to the inside wall of the catch ring 153 due to centrifugal force. Please note that each spindle frame 11 or 21 has guides 157 (FIG. 36) formed in an L-shape, as illustrated in FIG. 40 (A), and secured to the frame 11 or 21 by machine screws 159**.

Figure 36:
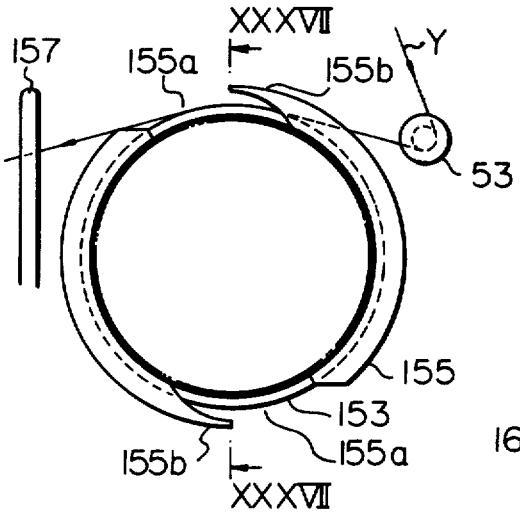
FIG. 36 is a plan view of a yarn threading portion.

A yarn Y running in a direction denoted by the arrow in FIG. 36 moves from the yarn guide 53 to the guide 157. The yarn guide 53 is moved downward in FIG. 36 so that the yarn Y comes in contact with the catch ring 153. In this condition, a relative axial movement between the spindle 15 or 25 and the yarn guide 53 is caused by axially moving the yarn guide 53 as illustrated in FIG. 40(B) or by axially moving the spindle 15 or 25. When the yarn intersects the notch **155*a*, the yarn Y is caught between the annular holding plate 151 and the catch ring 153 and is rigidly held there due to the centrifugal force acting on the annular holding plate 151. As the spindle 15 or 25 rotates, the yarn is cut at a position downstream from the notch 155*a* where the yarn Y is rigidly held because of the increased tension. Because the yarn is caught between the annular holding plate 151 and the catch ring 153, and while the yarn Y is axially moved relative to the catch ring, no substantial bunch windings occur. In addition, when the rotation of the spindle 15 or 25 in stopped, the yarn end can easily be taken up from the clearance between the annular holding plate 151 and the catch ring 153** because of the diminution of the centrifugal force.

Figure 6:
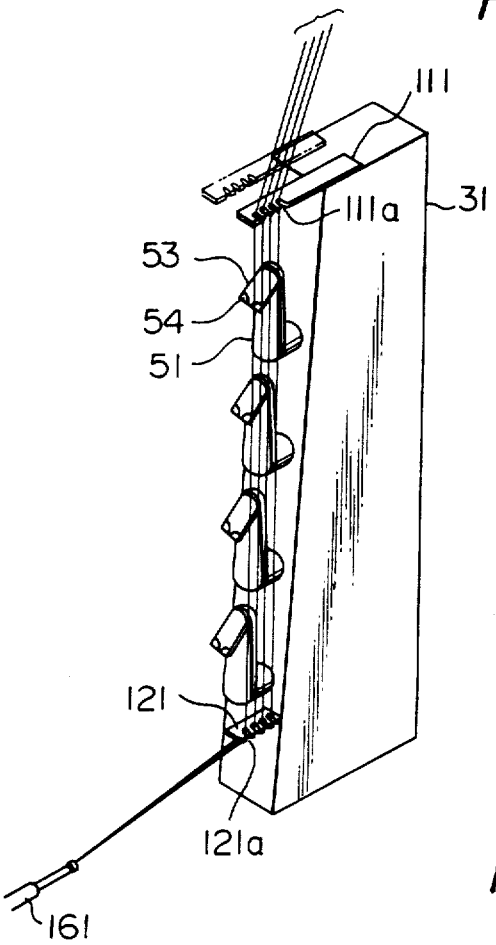
FIG. 6 is a perspective view of the threading arm frame illustrated in FIG. 3.
Figure 9:
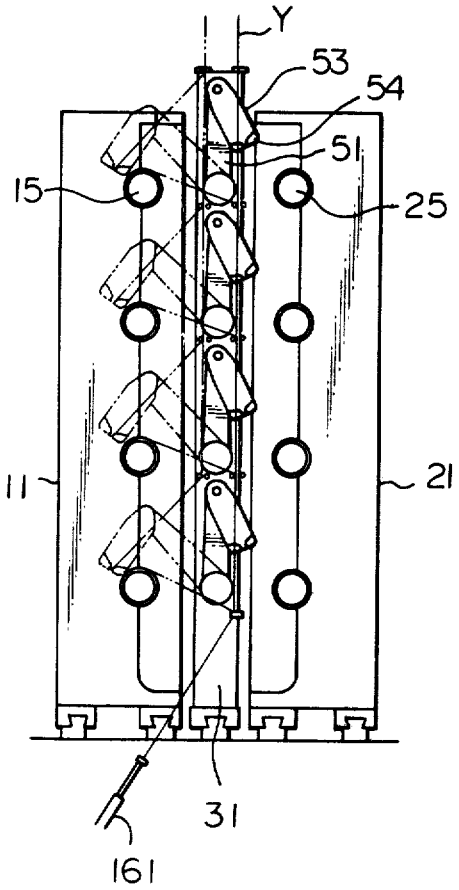
FIG. 9 is an elevational view illustrating an initial yarn threading operation.

The threading operation will now be explained. In FIGS. 6, 9 and 10, four yarns Y supplied from a spinneret of a melt spinning apparatus through a cooling chimney at a high speed, for example about 5000 m/min, are sucked together by a conventionally known take up device, such as a suction gun 161. At this time, the threading arms 51 as well as the yarn guides 53 pivoted thereon are vertically aligned as illustrated in FIG. 6. Each yarn Y is introduced into such a yarn passage so that it moves from the guide eye **111*a* formed on the yarn passage guide 111 to the guide element 121*a* formed on the yarn holding guide 121**. Accordingly, the four yarns Y parallelly move, the distance between the adjacent running yarns being the previously explained predetermined length l.

Figures 7A, 7B, 7C, 7D:
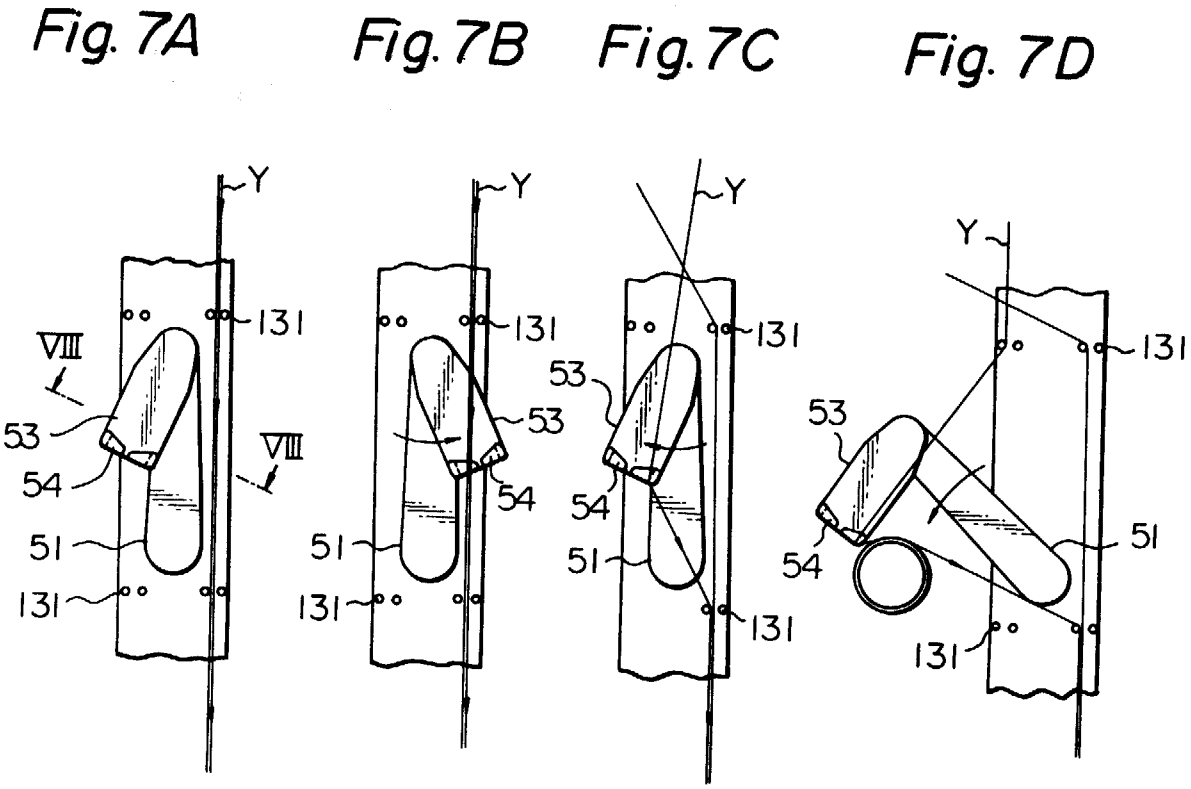
FIGS. 7 (A) through 7 (D) are elevational views sequentially illustrating the operations of the arm and the yarn guide.
Figure 37:
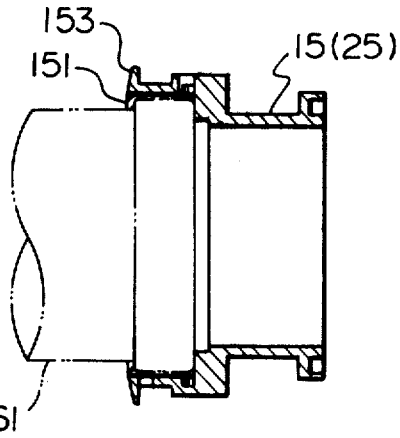
FIG. 37 is a cross sectional view taken along line XXXVII—XXXVII in FIG. 36.
Figure 38:
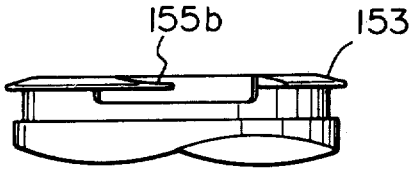
FIG. 38 is an elevational view of FIG. 36.

The threading arm frame 31 is moved relative to the spindle frame 15 or 25 when the threading arm frame 31 is movable, or the spindle frame 15 or 25 is moved relative to the threading arm frame 31 when the threading arm frame 31 is fixed, so that the respective yarn guides 53 mounted on the threading arm frame 31 correspond to the yarn threading portions which are formed at positions adjacent to the ends of the bobbins, as illustrated in FIG. 37, or which are peripheral grooves **163*a* formed on the bobbins 163 inserted onto the spindles 15 or 25. When the threading arms 51 and yarn guides 53 are moved across the yarn passage, as illustrated in FIG. 7B, the yarn Y is slid over the inclined surface 54*a* of the guide elements 54 attached to the yarn guide 53 as illustrated in FIG. 8, and is then held within the yarn holding space 54C. When this happens, please note that the yarns are apart from each other by the distance l and that the yarn guides 53 are also axially displaced from each other by the distance l, and, accordingly, the respective yarns Y are caught by the respective corresponding yarn guides 53. Thereafter, the yarn passage guide 111 is moved from a position denoted by a solid line to a position denoted by a dot-dash line in FIG. 6 by a pneumatic cylinder 113 shown in FIG. 1, and the threading arms 51 are swung in a direction opposite to the previous moving direction, as illustrated in FIG. 7(D), and the yarn guides 53 are also swung. As a result, the yarn Y moves along a zig-zag passage from the upper yarn passage restricting guide 131 located just above the threading arm 51 to the lower yarn passage restricting guide 131 located just below the threading arm 51 through the guide element 54 on the yarn guide 53, as illustrated in FIG. 7(D). Please note that as the yarn passage guide 111 and the yarn threading arms 51, as well as the threading guides 53, are moved, the yarns Y are moved and that only the yarn Y corresponding to the thread guide 53 is moved along the zig-zag passage due to the passage restricting guides 131. The yarn Y moving along the zig-zag passage comes into contact with the threading portion formed adjacent to the end of the bobbin 163 or formed on the bobbin 163, and it is caught there. Accordingly, the yarn Y is held by the bobbin 163** and is wound thereon.

The bobbin changing operation from the left spindle 15 to the right spindle 25 will now be explained with reference to FIGS. 12(A) through 17(B), wherein an apparatus with an axially movable threading arm frame 31(FIG. 1) is used.

The yarn Y is axially traversed to an fro by the guide element 54 along the rotating left spindle 15 in accordance with a traverse sequential program, which will be explained later, and is wound onto the bobbin 161 inserted onto the spindle to form a package in a pirn shape (FIGS. 12(A) and 12(B)). During the winding operation, the yarn guide 53 is gradually tilted in a direction B, as illustrated in FIG. 5, as the amount of the package increases. Due to this tilting movement of the yarn guide 53, the angle at which the yarn Y wraps around the guide element 54 is kept substantially constant regardless of the increase of the package weight. Accordingly, the tension in the yarn Y to be wound is not excessively varied during the winding operation.

Figures 12A, 12B, 13A, 13B, 14A, 14B, 15A, 15B:
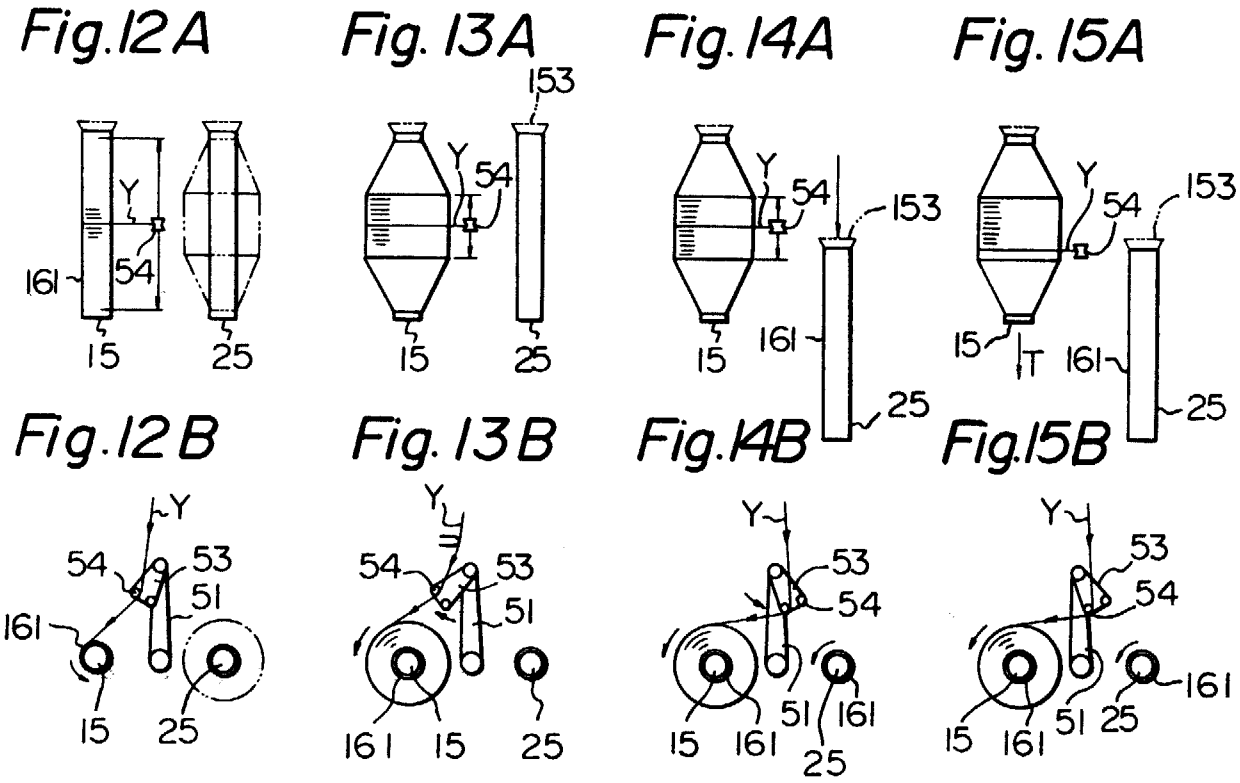
FIGS. 12 (A) through 17 (B) sequentially illustrate a bobbin changing operation from the left spindle to the right spindle in a yarn winding apparatus with an arm movable along the spindles, wherein respective figures with the suffix (A) are plan views, and respective figures with the suffix (B) are elevational views.

When or slightly before the yarn package is completed, as illustrated in FIGS. 13(A) and 13(B), the spindle 25 with an empty bobbin 161 is axially moved, as illustrated in FIG. 14(A), and is stopped at a position where the threading portion 153 on the spindle 25 is exposed to the traverse region of the full bobbin on the spindle 15, as illustrated in FIG. 14(A). During or slightly before the axial movement of the spindle 25 with the empty bobbin 161, the spindle 25 is commenced to rotate to a predetermined speed which is sufficiently high to wind up a yarn under a normal condition in a direction the same as that of the spindle 15 with the full bobbin. When the spindles 15 and 25 are rotated in the same direction, as described above, the yarns wound into packages have the same directioned twists therein. Contrary to this, if the spindles 15 and 25 are rotated in the opposite directions, the yarns wound into packages formed on the spindles 15 and 25 have opposite twists therein and may cause some trouble due to the opposite twists in the subsequent processes. However, in the latter case, the relationship between the yarn passage and the rotating spindle is always constant regardless of the spindles 15 and 25, and accordingly, the threading operation may be easy. The yarn guide 53 is swung counterclockwise (FIG. 14(B)) so that it is directed to the empty bobbin on the spindle 25.

As soon as the guide element 54 on the yarn guide 53 is aligned with the threading portion 153 on the spindle 25, as illustrated in FIG. 15(A), the traverse motion of the threading arm 51 is stopped there. At the same time, the spindle 15 with the full bobbin commences its traverse motion, as denoted by the arrow T, in order to prevent bunch windings on the full bobbin and to ensure continuous normal winding. Please note that the spindle 25 with the empty bobbin is stopped at such a position that the threading portion 153 mounted thereon is located away from the traverse end of the threading arm near the base portion of the spindle 15. Furthermore, please note that the spindle 15 with a full bobbin commences to move in such a direction that the base portion of the spindle 15 nears the guide element 54 on the yarn guide. Because the threading arm 51 is stopped at a particular position and the spindle 15 with the full bobbin commences to move in a particular direction, a relatively large traverse region remains before the traverse direction of the spindle 15 is changed.

Figures 16A, 16B, 17A, 17B, 18A, 18B, 19A, 19B:
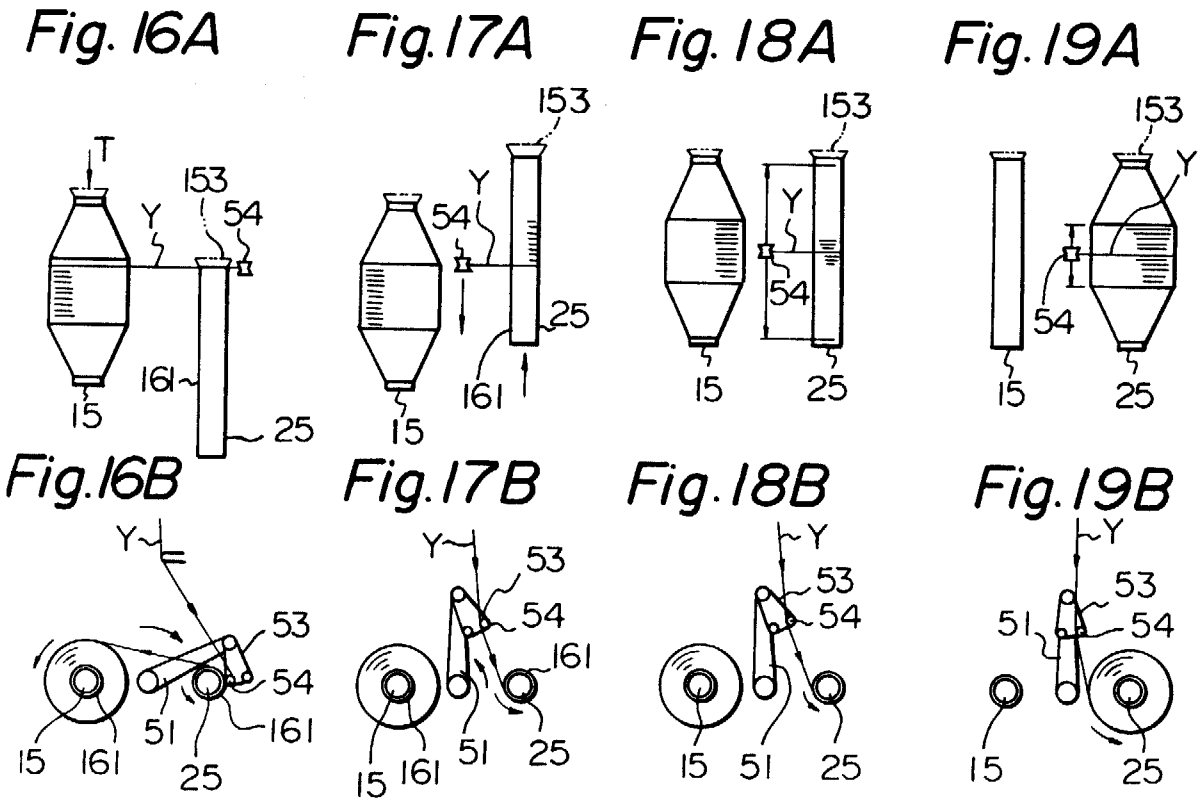
FIGS. 18 (A) through 23 (B) sequentially illustrate a bobbin changing operation from the right spindle to the left spindle in a yarn winding apparatus with an arm movable along the spindles, wherein respective figures with the suffix (A) are plan views, and respective figures with the suffix (B) are elevational views.

Thereafter, the threading arm 51 is swung clockwise toward the threading portion 153 formed adjacent to or on the empty bobbin 161 mounted on the rotating spindle 25 by means of the pneumatic cylinders 89 and 93 (FIG. 3), as illustrated in FIG. 16(B). Accordingly, the yarn Y extending between the guide element 54 and the full bobbin on the spindle 15 comes into contact with the threading portion 153 formed on the spindle 25 and is caught thereby. In this case, please note that the threading of the yarn Y onto the threading portion 153 is performed under the condition that there is no relative movement between the yarn guide 53 and the empty bobbin 163. Accordingly, the threading operation can be surely done with a high success ratio. Furthermore, please also note that the normal winding is not disturbed because of the traverse motion of the full bobbin, even if the traverse motion of the threading arm 51 is entirely stopped.

The tilted threading arm 51 as well as the yarn guide 53 are returned to their original neutral positions, as illustrated in FIG. 17(B). At the same time, the traverse motion of the threading arm 51 with the guide element 54 is commenced, and the empty bobbin held on the spindle 25 and having yarn threaded thereon is returned to a normal winding position, as illustrated in FIG. 17(A). In this case, please note that the threading arm 51 commences to move in a direction opposite to that of the spindle 25. As a result, the yarn Y is wound onto the bobbin held by the spindle 25 at a relatively rough pitch until the spindle 25 reaches its normal position. A package with an initial yarn layer of a roughly wound pitch is found to be preferable for smooth withdrawal of yarn in a subsequent process. The bobbin changing operation from the right spindle 25 to the left spindle 25 is very similar to the above-described operation, and, accordingly, the operation will now briefly be explained with reference to FIGS. 18(A) through 23(B).

In FIGS. 18(A) and 18(B), the yarn Y is axially traversed to and fro by the guide element 54 along the rotating right spindle 25 and is wound onto the bobbin held on the spindle 25 to form a package in a pirn shape.

Figure 20A:
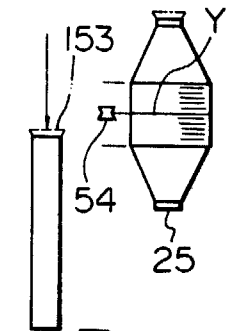

When the yarn package is completed, as illustrated in FIGS. 19(A) and 19(B), the spindle 15 with an empty bobbin commences to rotate and is axially moved, as illustrated in FIG. 20(A), and is stopped at a position where the threading portion 153 on the spindle 15 is exposed to the traverse region of the full bobbin on the spindle 25, as illustrated in FIG. 20(A). The yarn guide 53 is swung clockwise (FIG. 20(B)).

Figure 21A:
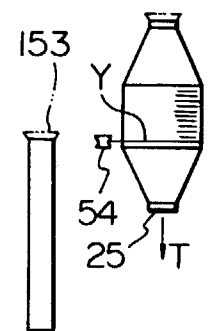

As soon as the guide element 54 on the yarn guide 53 is aligned with the threading portion 153 on the spindle 15, as illustrated in FIG. 21(A), the traverse motion of the threading arm 51 is stopped there. At the same time, the traverse motion of the spindle 25 with the full bobbin commences, as denoted by arrow T.

Figure 22B:
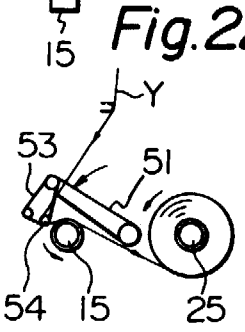
Figure 21B:
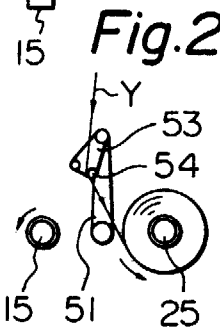
Figure 20B:
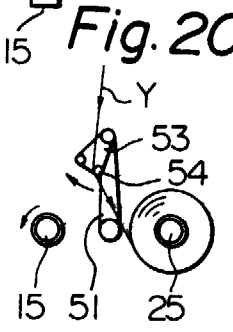

Thereafter, the threading arm 51 is swung counterclockwise toward the threading portion 153 on the rotating spindle 25, as illustrated in FIG. 22(B). Accordingly, the yarn Y extending between the guide element 54 and the full bobbin on the spindle 25 comes into contact with the threading portion 153 on the spindle 15 and is caught thereby.

Figure 23A:
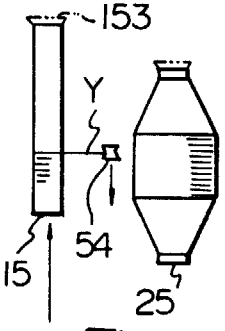
Figure 22A:
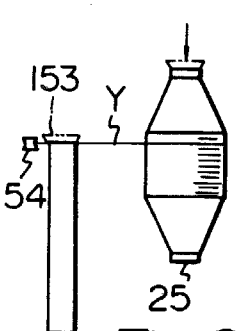
Figure 23B:
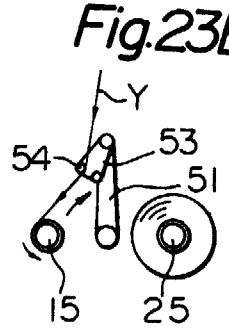

The traverse motion of the threading arm 51 with guide element 54 is commenced, and the empty bobbin held on the spindle 15 and having yarn threaded thereon is returned to a normal winding position, as illustrated in FIG. 23(A). The tilted threading arm 51 as well as the yarn guide 53 are returned to their original neutral positions, as illustrated in FIG. 23(B), after the threading operation is completed.

Figure 43A:
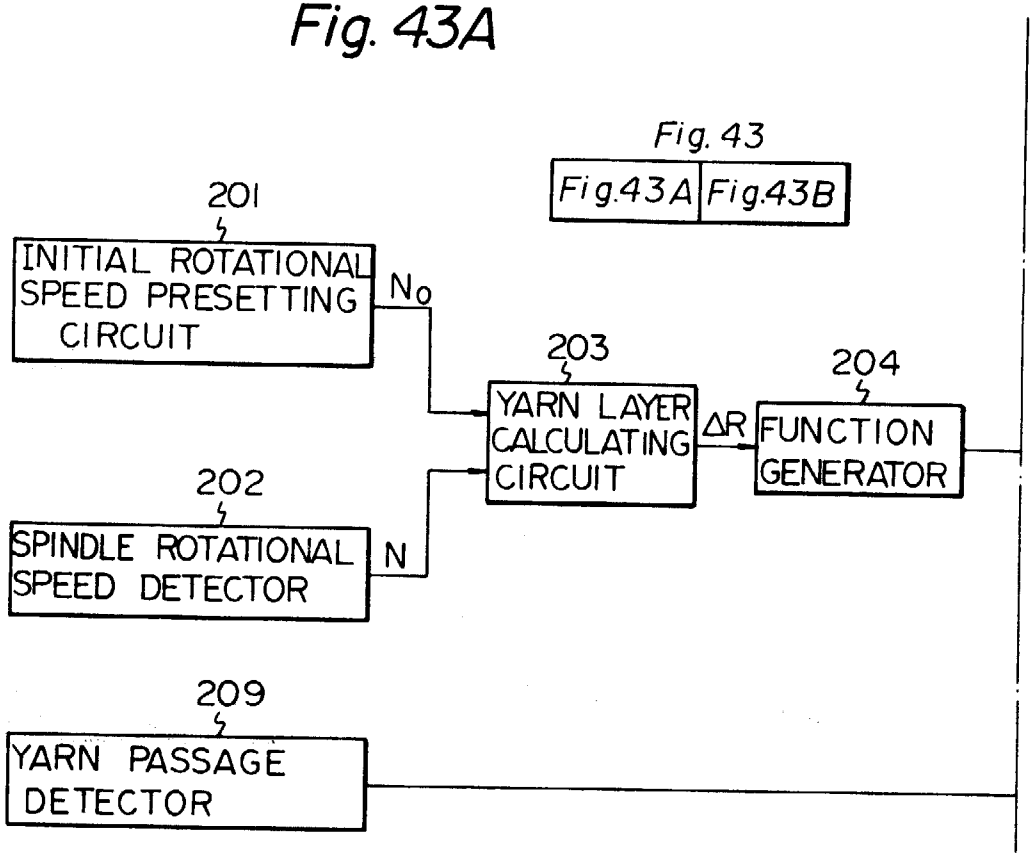
Figure 43B:
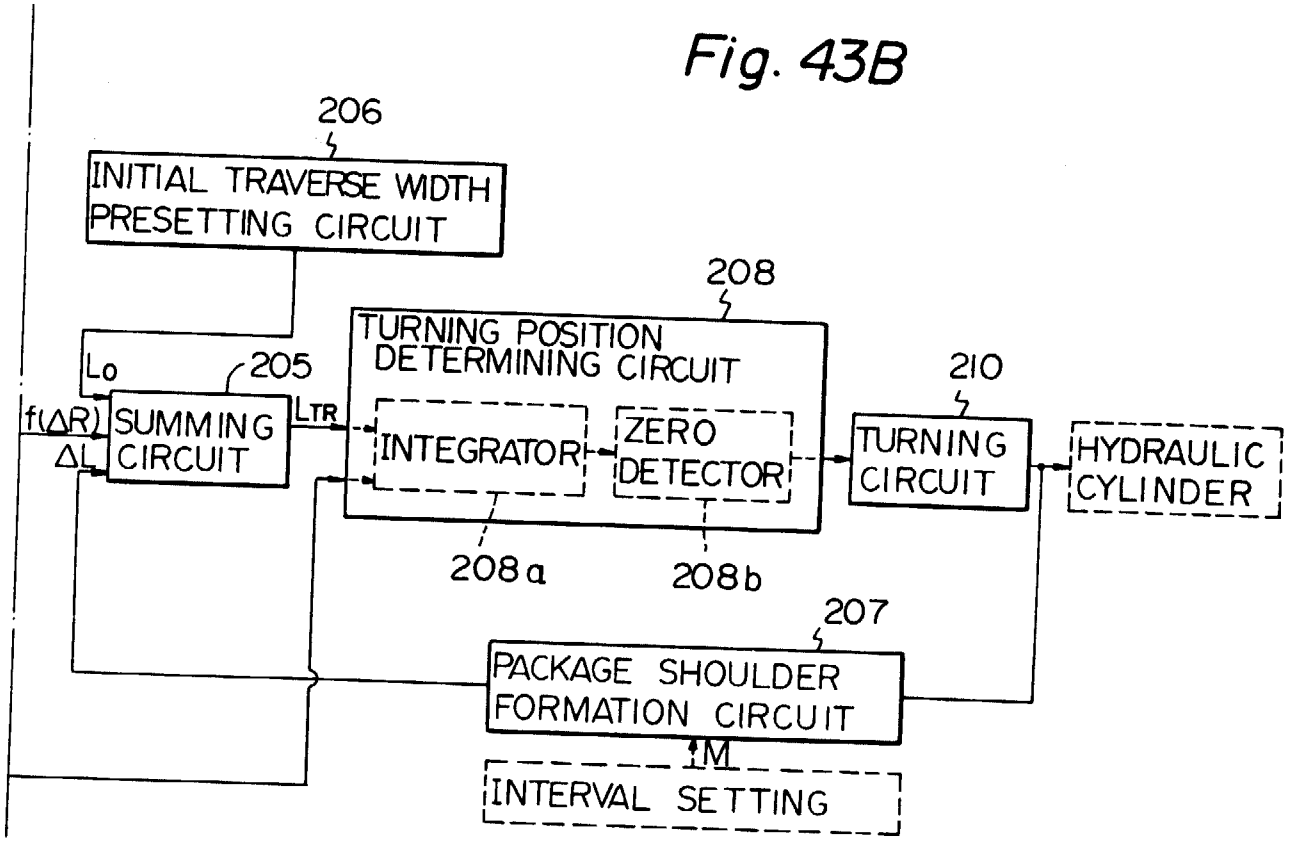
Figures 48, 48A, 48B:
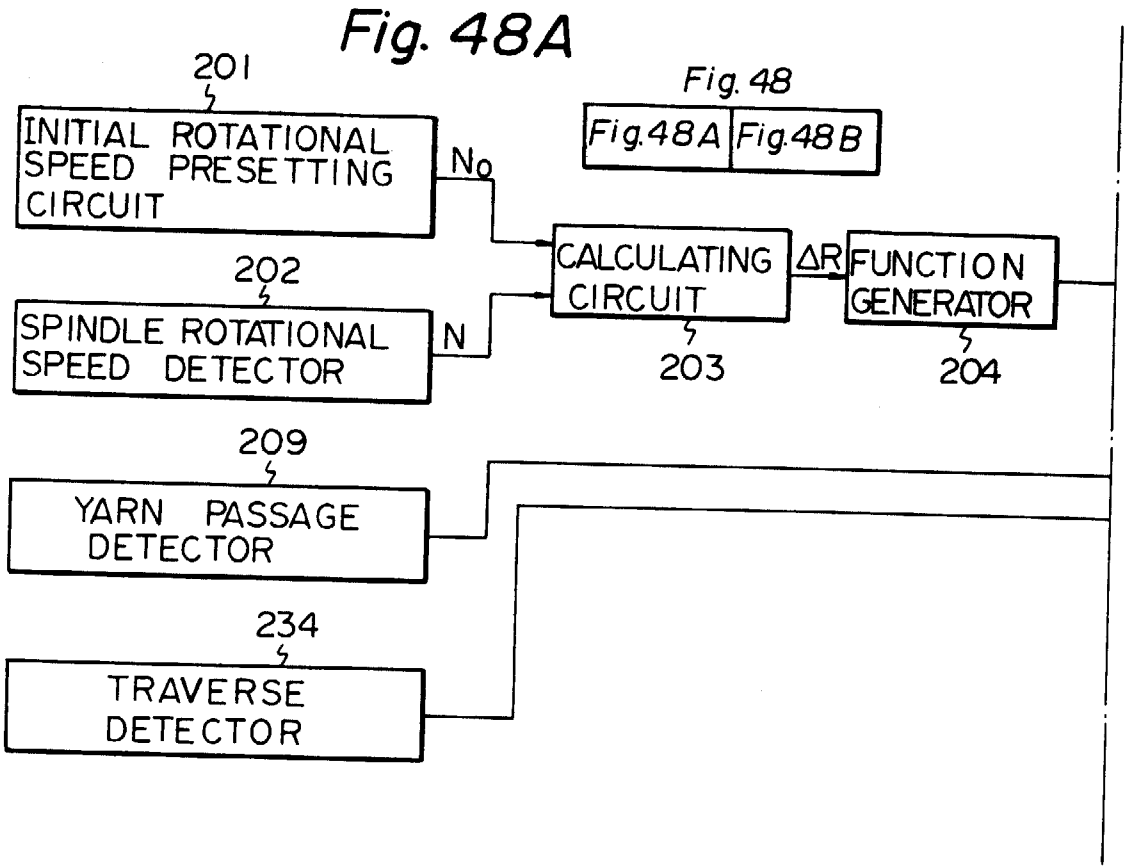
FIGS. 48, 48A and 48B are flow diagrams for controlling traverse motion.
Figure 48B:
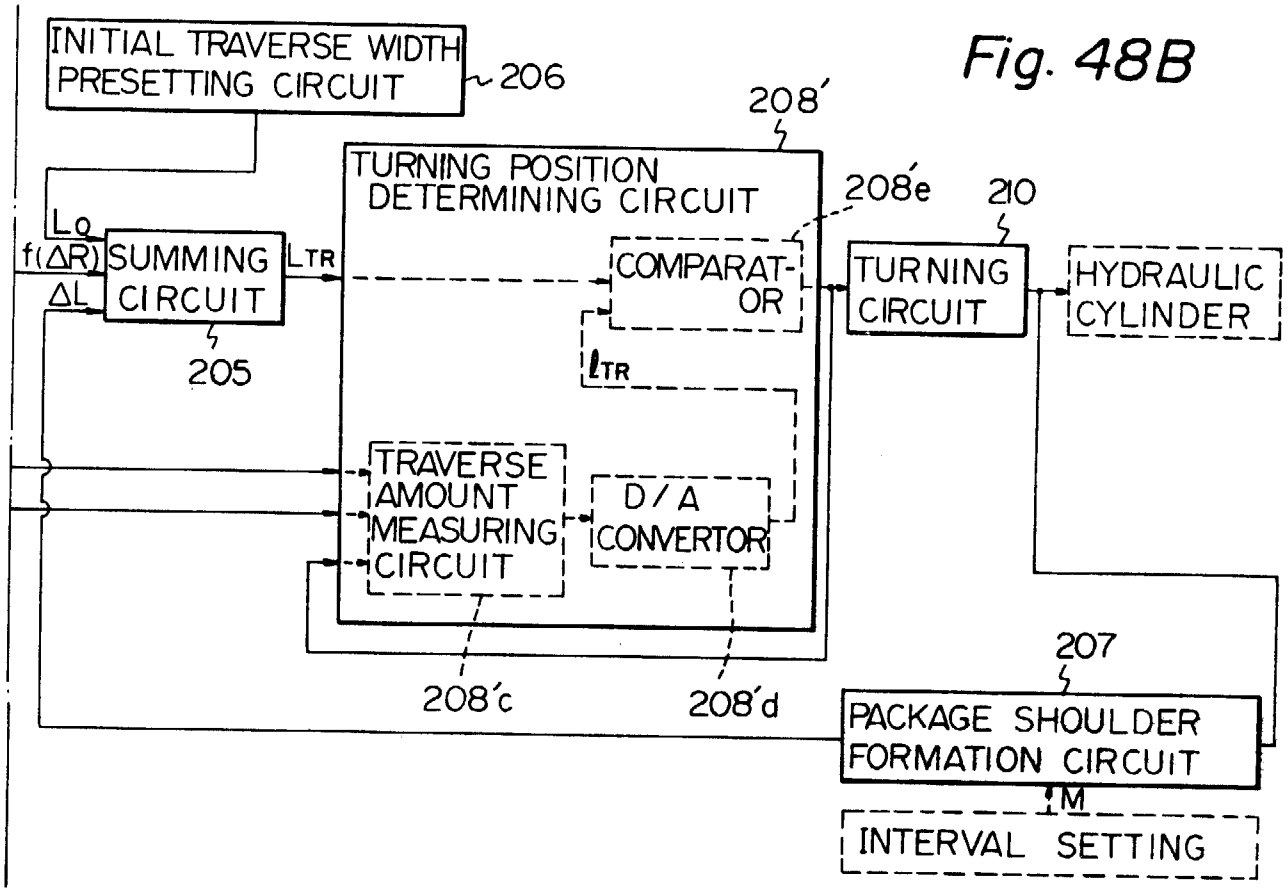
Figures 51, 51A, 51B:
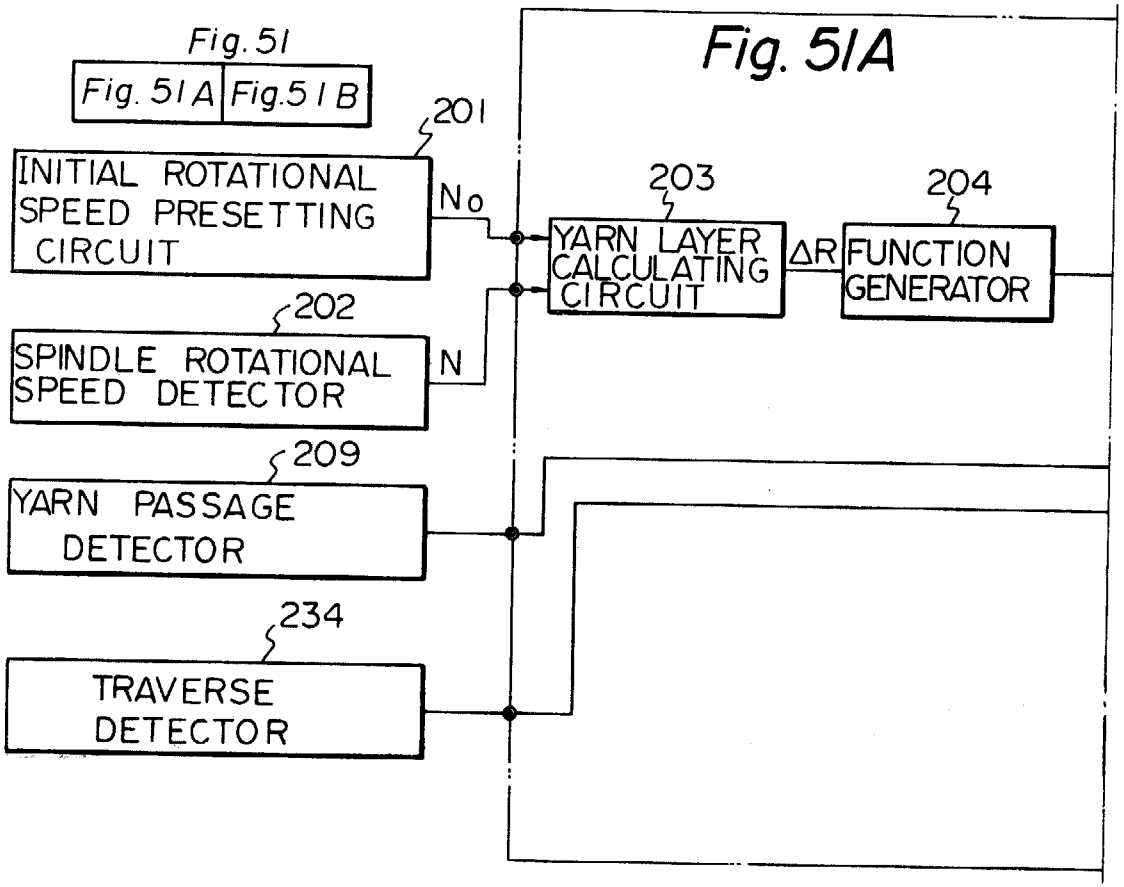
FIGS. 51, 51A and 51B are flow diagrams for controlling traverse motion.
Figure 51B:
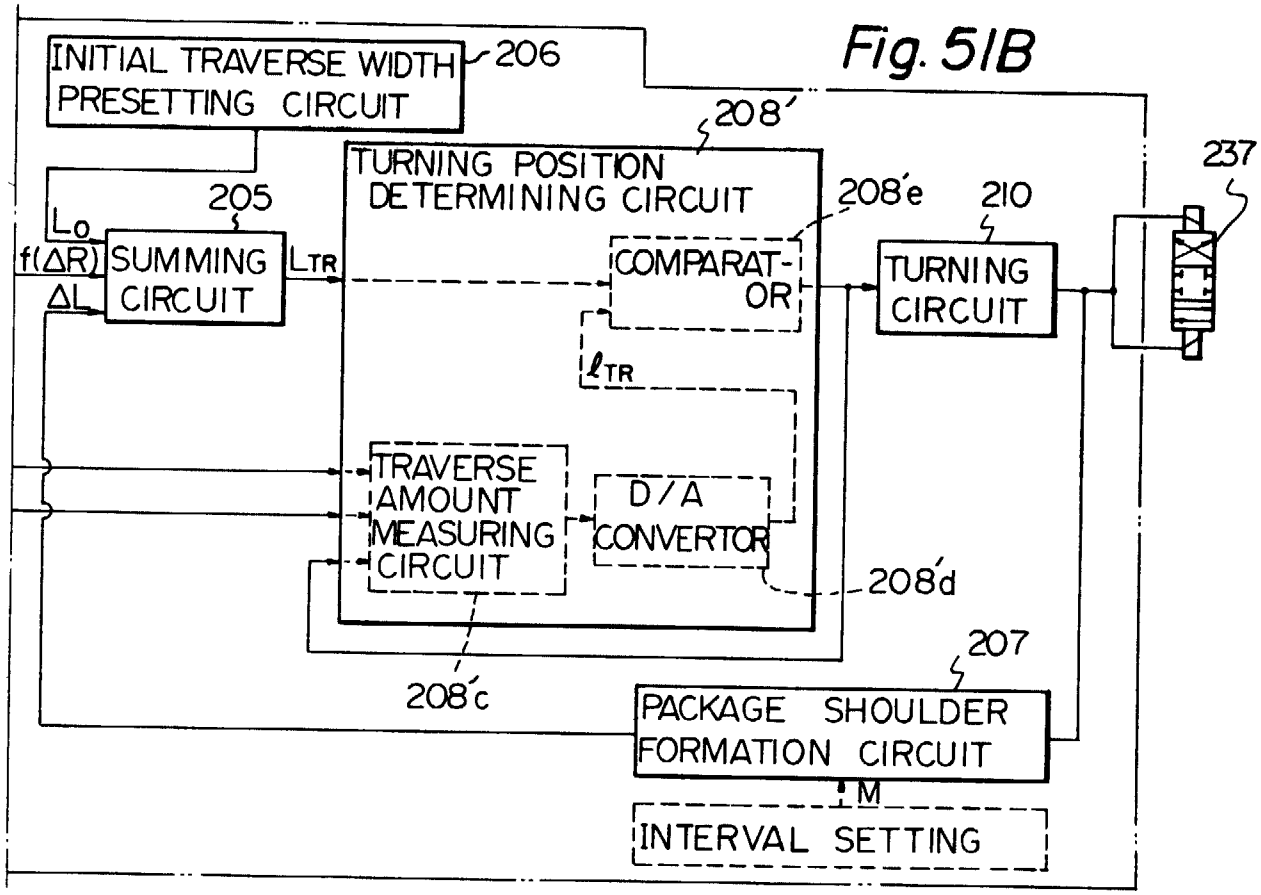
Figure 52:
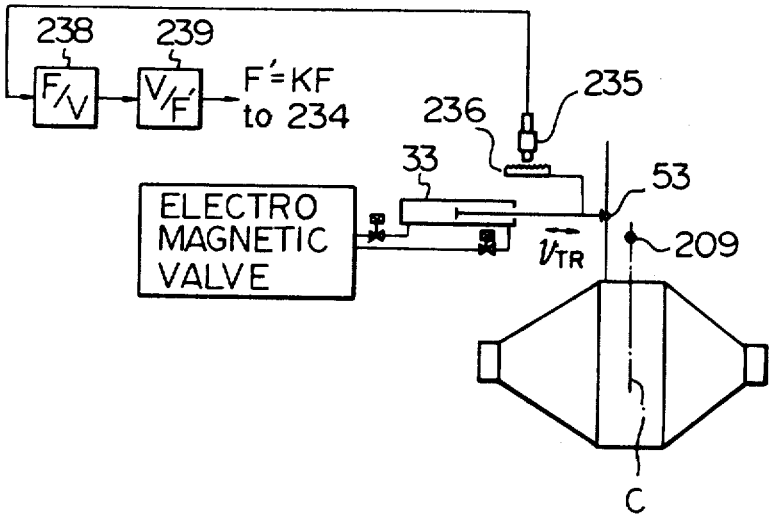
FIG. 52 is a schematic side view illustrating traversing portion.

The traverse motion of the threading arm 51 mounted on the threading arm frame 31 (FIGS. 1 and 2) is performed by means of the hydraulic cylinder 33 which is controlled by means of a control circuit illustrated in FIGS. 43, 48 or 51. The positioning of the threading arm 51 while it threads a yarn onto an empty bobbin is achieved by abutting it with a mechanical stop and stopping the supply of compressed oil into the hydraulic cylinder 33. The detailed explanation of this controlling method is believed to be unnecessary, because it is believed to be obvious to a person engaged in the art. The axial movements of the spindle frames 11 and 21 with the spindles 15 and 25 are actuated by means of the hydraulic cylinders 13 and 23, respectively, which are controlled by a microcomputer in accordance with a predetermined sequential program, the technology of which is also believed to be obvious to a person skilled in the art, and, accordingly, its detailed explanation is omitted here.

In the above-explained embodiment, a yarn Y is traversed by the yarn guide 53 on the threading arm 51 mounted on the threading arm frame 31 during the normal winding operation. However, according to the present invention, a yarn can axially be traversed to and fro by the traverse motion of the spindle 15 or 25 having an empty bobbin inserted thereon, instead of the traverse motion of the threading arm 51. In this case, since the threading arm does not move axially, the threading arm frame 31 can be stationary; in other words, it is fixed on the base machine frame 1, and, accordingly, the hydraulic cylinder 33, connected to the threading arm frame 31 and illustrated in FIGS. 1 and 2, can be omitted.

The bobbin changing operation in a spindle traverse type winding apparatus will now be explained.

Figures 24A, 24B, 25A, 25B, 26A, 26B, 27A, 27B:
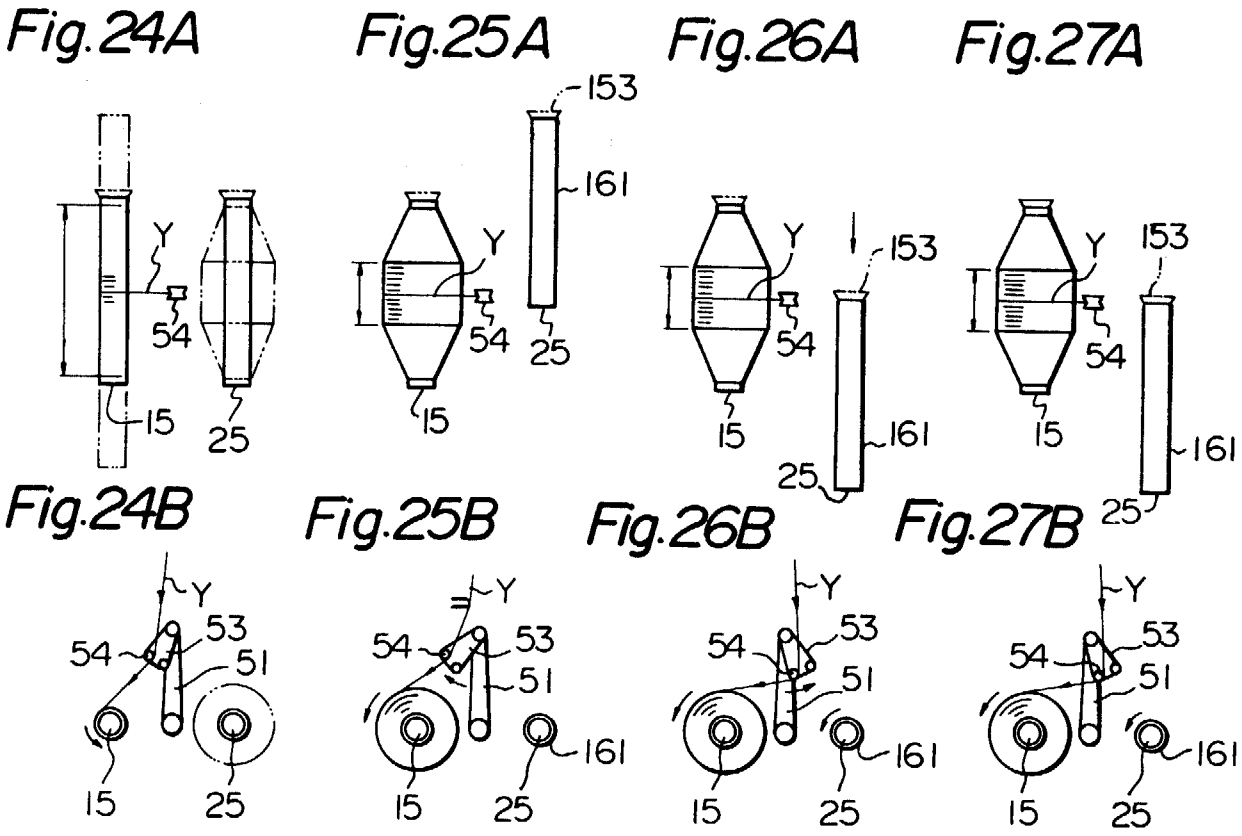
FIGS. 24 (A) through 29 (B) sequentially illustrate a bobbin changing operation from the left spindle to the right spindle in a yarn winding apparatus with spindles which can do traverse motion, wherein figures with the suffix (A) are plan views, and figures with the suffix (B) are elevational views.

In FIG. 24(A), the yarn guide 53 with the guide element 54 is stationary, and the left spindle 15 with an empty bobbin is axially traversed to and fro by means of a hydraulic cylinder 13 (FIG. 1). The traverse width of the hydraulic cylinder 13 is gradually decreased as the thickness of the yarn layer on the bobbin increases. The inclination of the yarn guide 53 is gradually increased in the clockwise direction by means of the actuating mechanism, explained above with reference to FIG. 3, as is apparent from comparing FIGS. 24(B) and 25(B).

Before the package formed on the left spindle 15 becomes full, the full bobbin formed on the right spindle 25 has been doffed, and an empty bobbin is donned onto the right spindle 25.

When the full package is completed on the left spindle 15, the right spindle 25 is axially moved so that the yarn threading portion 153 is aligned with the yarn guide 54, as illustrated in FIG. 26(A). In addition, the yarn guide 53 is swung counterclockwise, as illustrated in FIG. 26(B), and, at the same time or slightly before the yarn guide 53 is swung, the right spindle 25 commences its rotation.

Figure 28A:
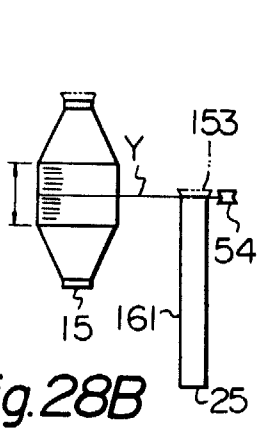
Figure 28B:
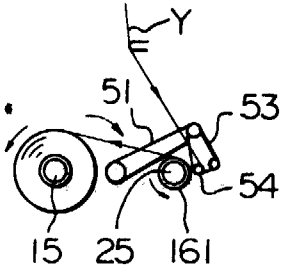

After the rotating speed of the right spindle 25 reaches a predetermined value, the threading arm 51 is swung clockwise, as illustrated in FIGS. 28(A) and 28(B), and, accordingly, the yarn Y extending from the guide element 54 to the full bobbin formed on the spindle 15 comes in contact with the threading portion 153 on the right spindle 25 and is caught by the threading portion 153.

Figure 29A:
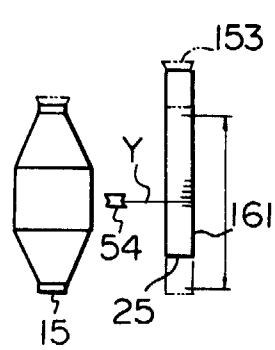
Figure 29B:
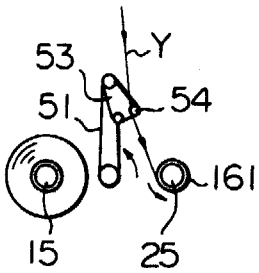

Thereafter, both the rotation and the traverse motion of the left spindle 15 are stopped, and the right spindle 25 commences its normal traverse motion after it returns to its normal position. The threading arm 51 is then swung counterclockwise and is returned to its normal neutral position, as illustrated in FIG. 29(B). The bobbin changing operation from the right spindle 25 to the left spindle 15 is very similar to the above-explained operation, and will now be briefly explained.

Figure 31A:
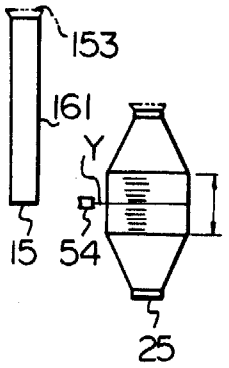
Figure 31B:
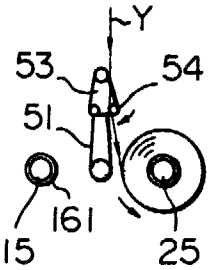
Figure 30A:
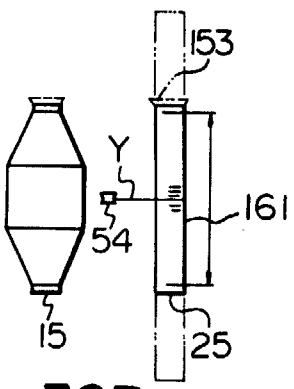
FIGS. 30 (A) through 35 (B) sequentially illustrate a bobbin changing operation from the left spindle to the right spindle in a yarn winding apparatus with spindles which can do traverse motion, wherein figures with the suffix (A) are plan views, and figures with the suffix (B) are elevational views.
Figure 30B:
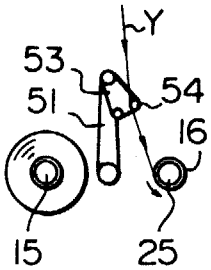

In FIGS. 30(A) and 30(B), a yarn Y is wound onto the bobbin inserted onto the right spindle 25, as the right spindle 25 is axially traversed to and fro. The full bobbin formed on the left spindle 15 must be doffed before the bobbin changing operation (FIGS. 31(A) and 31(B)).

Figures 32A, 32B, 33A, 33B, 34A, 34B, 35A, 35B:
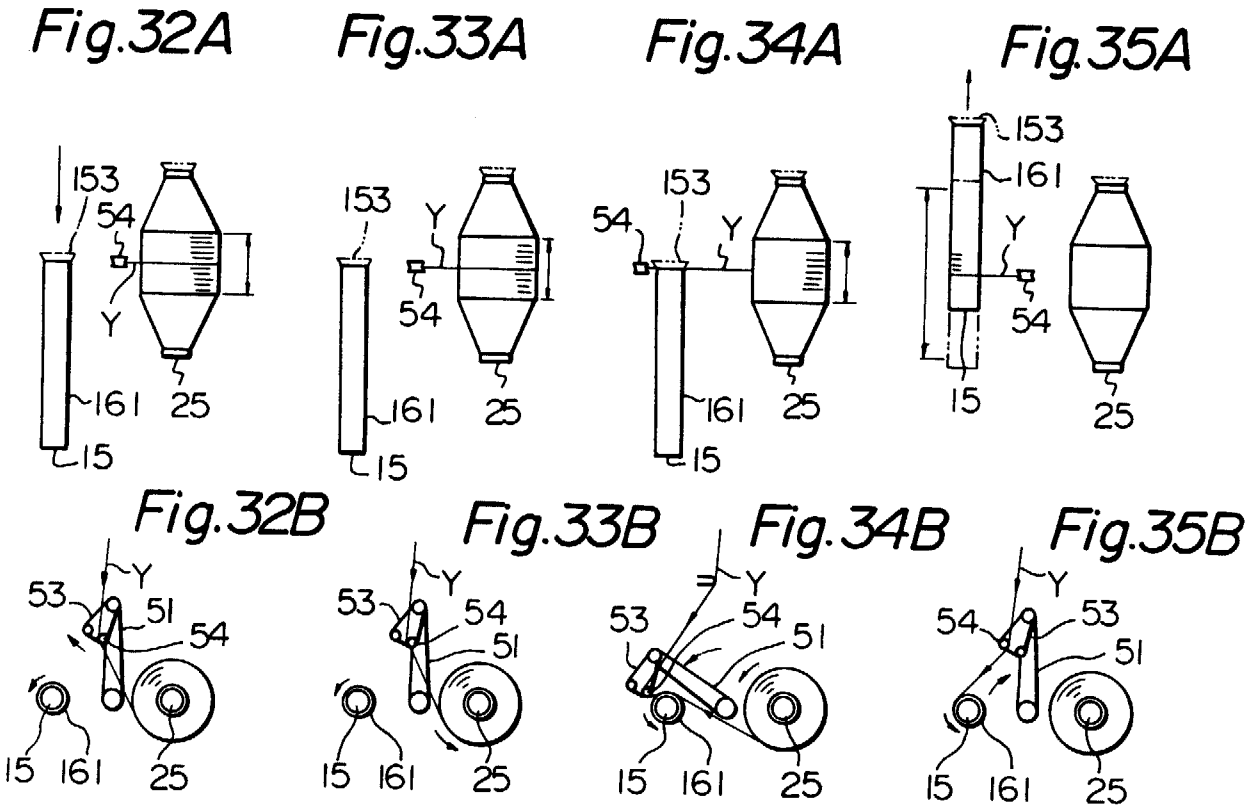

When a full package is completed on the right spindle 25, the left spindle 15 with an empty bobbin moves axially so that the threading portion 153 is aligned with the threading arm 54, as illustrated in FIG. 32(A). At the same time, the left spindle 25 commences its rotation, when or slightly before the yarn guide 53 is swung clockwise, as illustrated in FIG. 32(B).

After the rotational speed of the left spindle becomes a predetermined high speed, the threading arm 51 is swung counterclockwise, as illustrated in FIG. 34(B), and the yarn is caught by the threading portion 153.

Thereafter, the rotation and the traverse motion of the right spindle 25 are stopped. The left spindle 15 is axially moved to its normal position, and the traverse motion thereof commences, and the threading arm 51 is returned to its normal neutral position.

An especially designed sequence program circuit for controlling the traverse motion of the threading arm is used in the apparatus for winding a plurality of yarns according to the present invention and will now be explained.

Referring to FIG. 43, a presetting circuit 201 is used to preset an initial rotational speed No. of an empty bobbin inserted onto a spindle 15 or 25. A detector 202 detects the rotational speed of the spindle, which rotational speed is varied as time elapses, while the yarn running speed is kept constant. A calculation circuit 203 has inputs, connected to the presetting circuit 201 and the detector 202, and calculates the thickness ΔR of the yarn layer based on the signals from the presetting circuit 201 and the detector 202. The thickness ΔR can be calculated from the equation (1).

$$\Delta R = Ro(T - To/To) = Ro(No - N/N) \quad (1)$$

In the equation (1), Ro denotes the radius of the empty bobbin, To denotes an initial rotational interval and equals 1/No, and T denotes the rotational interval and equals 1/N.

The output of the calculating circuit 203 is connected to a function generator 204 which generates an output function f(ΔR) based on the input ΔR. The output function f(ΔR) corresponds to the amount which should be reduced from the initial traverse width and is added to a summing circuit 205 in order to obtain a traverse width. The summing circuit 205 is also connected to an initial traverse width presetting circuit Lo which gives an output corresponding to the initial traverse width Lo, and it is further connected to a package shoulder formation circuit 207 which gives an output ΔL, and as a result, the summing circuit determines the traverse width $L_{TR}$. The output $L_{TR}$ of the summing circuit 205 is connected to a circuit 208 for determining the turning position of the traverse motion, which comprises an integrator 208*a* and a zero detector 208*b*. The output of the yarn passage detector 209 is also input to the turning position detecting circuit 208, so that a signal is issued to a traverse motion turning circuit 210 which actuates the hydraulic cylinder 23 (FIGS. 1 and 45).

Figure 44:
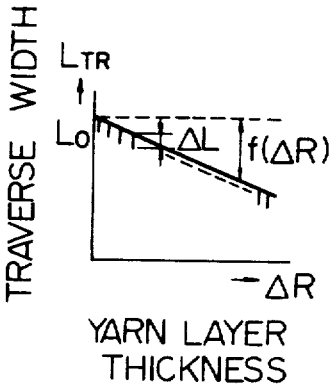
FIG. 44 is a diagram illustrating the relationship between the traverse width $L_{TR}$ and the wound yarn thickness $\Delta R$.

FIG. 44 shows the relationship between the traverse width $L_{TR}$ and the yarn layer thickness ΔR. Since the package is wound in a pirn shape, the shoulders of the package must be tapered, and the output f(ΔR) of the function generator 204 is proportionally increased as the yarn layer thickness ΔR increases. Please note that in FIG. 44, the yarn layer thickness ΔL is intermittently increased in order to prevent the generation of a bulge caused by the deceleration of the traverse motion. The package shoulder formation circuit 207 generates zero outputs for M-1 traverse motions and an output ΔL for one traverse motion in M times traverse motions. Accordingly, the output $L_{TR}$ of the summing circuit 205 is expressed by equation (2).

$$L_{TR}=Lo-f(\Delta R)-L \quad (2)$$

Figure 45:
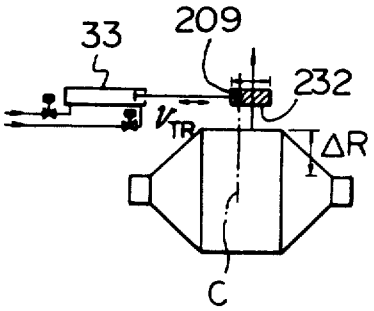
FIG. 45 is a schematic side view illustrating traversing portion.

The yarn passage detector 209 is located at a position corresponding to the center C of the traverse region, as illustrated in FIG. 45, and comprises a light emitter and a light receiver. A traverse guide is moved to and fro by means of the hydraulic cylinder 33 and has a cover 232 secured thereto and having a length of lo. When the cover 232 is traversed at a traverse speed of $V_{TR}$, the light from the light emitter is covered for a time $\tau_0$ which equals $lo/V_{TR}$. The output of the summing circuit 205 is charged in the integrator 208*a* for the time $\tau_0$ wherein the light of the yarn passage detector is covered. After the cover 232 secured to the traverse guide passes by the yarn passage detector 209, the integrator commences to discharge and becomes zero after time $\tau_1$. When the zero detector 208 detects that the integrater is zero level, the turning circuit 210 operates to change the moving direction of the hydraulic cylinder 33.

Figure 46:
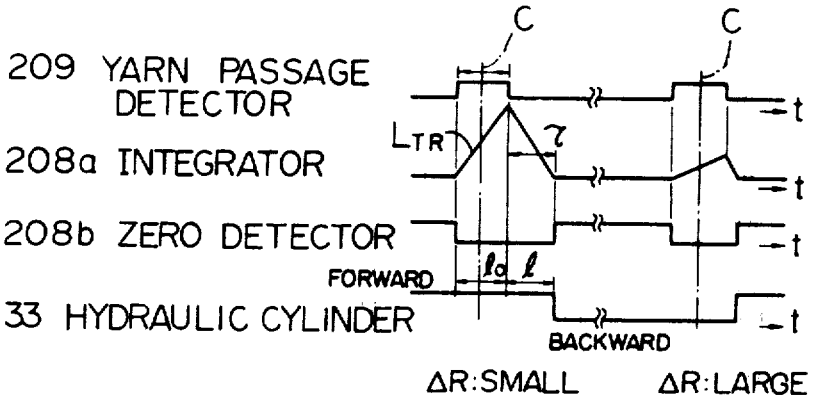
FIG. 46 is a sequential diagram of elements illustrated in FIG. 43.

FIG. 46 illustrates a diagram showing the relationships between the changes of the elements and the time t. The integrator 208*a* is proportionally charged for time $\tau_0$, that is, the coefficient of proportion relies on the amount $L_{TR}$, when the yarn passage detector 9 is covered. After time $\tau_0$ has elapsed, the integrator 208*a* discharges proportionally. When the yarn layer thickness $\Delta R$ is small, the amount $L_{TR}$ is large, and, accordingly, a large amount of electricity is charged into the integrator 208*a*. However, as the yarn layer thickness increases, the amount of charged electricity in the integrator 208*a* decreases, and, accordingly, the discharging time $\tau_1$ also decreases. As a result, the tapered package, as illustrated in FIG. 45, can be produced.

Figures 47, 47A, 47B:
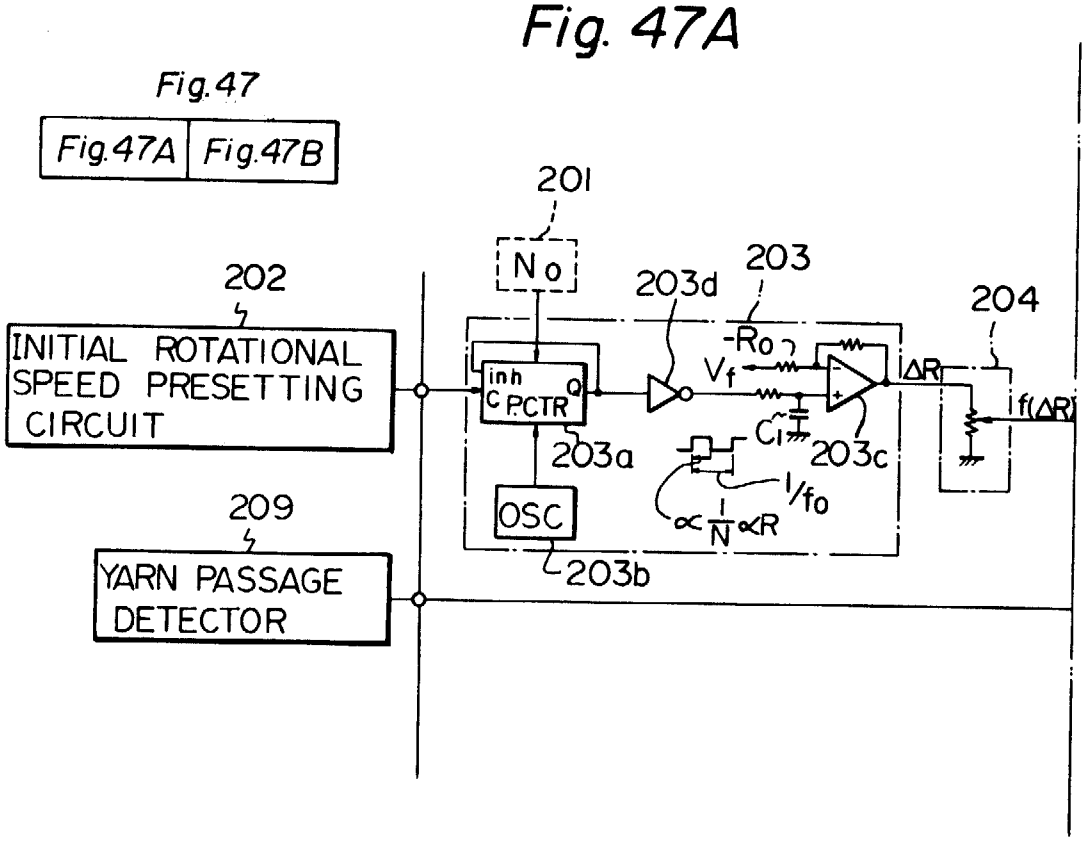
FIGS. 47, 47(a) and 47(b) are circuit diagrams of a control circuit utilized in FIG. 43.
Figure 47B:
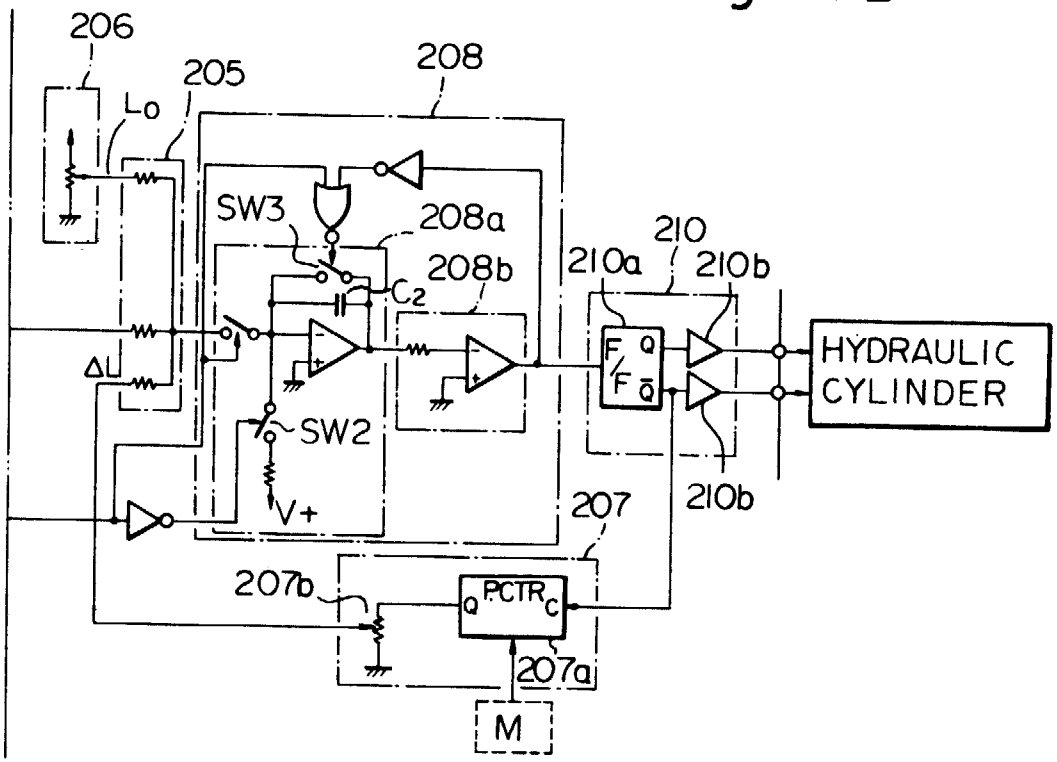

FIG. 47 is a circuit for realizing the flow illustrated in FIG. 43 wherein the same parts are denoted by the same reference numerals. The yarn layer calculating circuit 203 comprises a programmable counter 203*a*, an oscillator 203*b*, an inverter 203*d* and a differential amplifier 203*c*. The turning circuit 210 comprises a flip-flop circuit 210*a* and power amplifiers 210*b*. The package shoulder formation circuit 207 comprises a programmable counter 207*a* and a presetting circuit 207*b*.

The above-described embodiment can be effectively utilized when the traverse speed $V_{TR}$ is always constant. However, if the traverse speed $V_{TR}$ varies, the preciseness of the traverse motion cannot fully be ensured, because the turning of the traverse motion depends on the charging related to the traverse speed and the discharging irrelated to the traverse motion.

Figure 49:
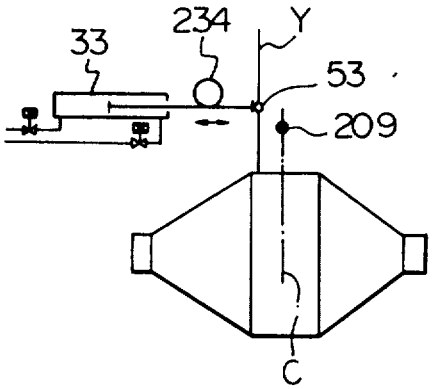
FIG. 49 is a schematic side view illustrating a traversing portion.
Figure 50:
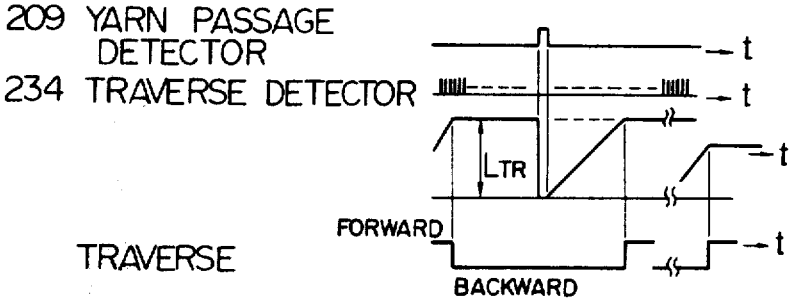
FIG. 50 is a sequential diagram of elements illustrated in FIG. 48.

FIGS. 48 through 50 illustrate an embodiment which is free from the traverse speed $V_{TR}$. The same parts are denoted by the same reference numerals, and, accordingly, the differences between FIG. 43 and FIG. 48 will now be briefly explained. As illustrated in FIG. 49, the yarn passage detector 209 is disposed at a position corresponding to the center C of the traverse region, and a rotary encoder 234, which is an embodiment of a traverse detector, engages with the hydraulic cylinder 33 so that the rotary encoder generates pulses as the hydraulic cylinder 33 actuates. The turning position determining circuit 208' in FIG. 48 comprises a traverse amount measuring circuit 208'*c*, a digital to analog (D/A) convertor 208'*d* and a comparator 208'*e*. The traverse amount measuring circuit resets and commences to count pulses generated by the rotary encoder when a yarn Y guided by the yarn guide 53 (FIG. 49) is detected by the yarn passage detector 209, and it counts the amount of traverse. The counted amount is converted into analog output $l_{TR}$ by means of the digital to analog convertor, which output $l_{TR}$ is input to the comparator 208'*e*. The comparator compares the output $l_{TR}$ from the digital to analog convertor with the output $L_{TR}$ from the summing circuit 205. When the outputs $l_{TR}$ and $L_{TR}$ become equal to each other, the turning circuit 210 is operated to change the traverse motion of the hydraulic cylinder 33.

FIG. 50 illustrates a diagram showing the relationships between the changes in some elements in FIG. 48 and time t.

The embodiment illustrated in FIG. 48 is not adversely affected by the changes in the traverse motion; however, the encoder 234 must always be kept clean and its maintenance is somewhat troublesome. Contrary to this, an embodiment illustrated in FIG. 51, which is a modification of that illustrated in FIG. 48, is very easy to maintain. Instead of the encoder 234, a magneticelectro detector 235 facing a rack 236 is used as a traverse detector. The output of the magneticelectro detector 235 is applied to a frequency to voltage converter 238, and then the output of the converter 238 is applied to a voltage to frequency converter 239, so that the number of the pulses generated by the converter 238 is increased in order to enhance the dissolving efficiency of the traverse motion. The hydraulic cylinder 33 is actuated by an electromagnetic valve 237 controlled by the turning circuit 210.

Figure 53:
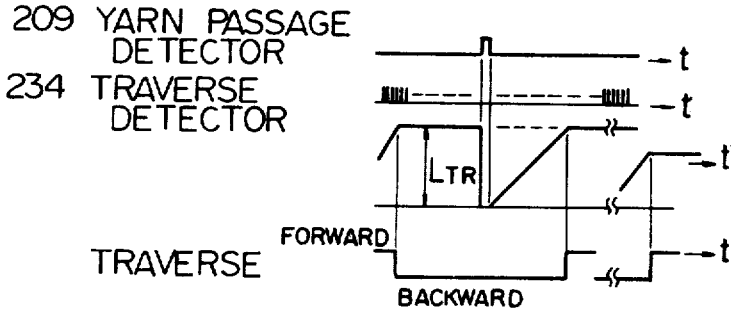
FIG. 53 is a sequential diagram of elements illustrated in FIG. 51.

FIG. 53 is similar to FIG. 50.

We claim:

1. An apparatus for winding a plurality of yarns comprising:

a pair of spindle frames independently and horizontally movable along parallel passages;

each of said spindle frames having a plurality of rotatable spindles horizontally projecting therefrom, which are vertically superposed and which are axially displaced by a predetermined length from the top spindle to the bottom spindle;

a threading arm frame disposed between said spindle frames and having threading arms pivotally mounted thereon, the number of said threading arms being the same as that said spindles mounted on each spindle frame, and the threading arms are axially displaced by said predetermined length from the top arm to the bottom arm; and electric motors connected to said rotatable spindles, respectively.

2. An apparatus according to claim 1, wherein said electric motors are induction motors.

3. An apparatus according to claim 1, wherein said threading arm frame is movable in parallel with said pair of spindle frames.

4. An apparatus according to claim 1, wherein said threading arm frame is fixed relative to said pair of spindle frames.

5. An apparatus according to claim 1, wherein said threading arms pivotally mounted on said threading arm frame have yarn guides mounted thereon pivotable in a plane perpendicular to the axis of said spindles.

6. An apparatus according to claim 5, which further comprises a yarn passage guide which is disposed at the upper portion of said threading arm frame and which is movable in a direction perpendicular to the axes of said spindles mounted on said spindle frames.

7. An apparatus according to claim 5 or 6, which further comprises a yarn holding guide projecting along said spindle from a position beneath the bottom spindle of said threading arm frame and having yarn guide elements mounted thereon being apart from each other.

8. An apparatus according to claim 7, wherein each of said yarn guides has a pair of inclined surfaces and a yarn holding space formed within said inclined surfaces, whereby a yarn guided along one of said inclined surfaces is held in said yarn holding space.

9. An apparatus according to claim 7, which further comprises at least one guide for restricting a yarn passage disposed between vertically adjacent threading arms, said yarn passage restricting guide comprising a pair of long guides located near said spindle frames and a pair of short guides located between said pair of long guides.

10. An apparatus according to claim 1, wherein driving parts of said induction motors are operatively connected to each other by means of a timing belt.

11. An apparatus according to claim 10, which further comprises at least one detector for detecting tension in a yarn to be wound onto one of said plurality of spindles, an output signal of said tension detector being applied to said plurality of electric motors so as to simultaneously control the rotating speeds of said plurality of induction motors.

12. An apparatus according to claim 11, wherein said motors are induction motors.

13. An apparatus according to claim 1, wherein the bottom portion of each of said spindles has an annular holding plate inserted thereon and a catch ring inserted on said annular holding plate, said catch ring has at least one notch and at least one hook located adjacent to said notch, whereby due to the centrifugal force caused by the rotation of said spindle, a yarn is held between said annular holding plate and said catch ring.

14. An apparatus according to claim 5, wherein said threading arm is connected to a hollow rotatable tube, one end of which is operatively connected to a first actuator, said yarn guide being operatively connected to a shaft extending through said hollow rotatable tube, one end of said shaft being operatively connected to a second actuator.

15. An apparatus according to claim 14, which further includes a rack connected to said second actuator, a pinion meshing with said rack, a ratchet wheel coaxially connected to said pinion and a pawl engaging with said ratchet wheel.

16. A method for continuously winding a yarn in a yarn winding apparatus having two spindles rotatably and axially slidably disposed in parallel with each other and a threading arm disposed between said two spindles, being axially movable and having a yarn guide swingable in a plane perpendicular to said spindles, comprising the steps of:

A. feeding a yarn to one of said spindles to be wound thereon while said arm is axially traversed to and fro;

B. when a predetermined amount of yarn is wound on the spindle, swinging said arm toward an empty bobbin inserted onto the other spindle;

C. when the bobbins are changed, moving the spindle with said empty bobbin from a standby position to a threading position wherein a yarn threading portion of said spindle is exposed to a range wherein the yarn is traversed to and fro to form a full bobbin;

D. then, stopping the traverse motion of said arm causing said thread guide mounted on said arm to correspond to said yarn threading portion, and moving the spindle having the full bobbin axially;

E. then swinging said arm toward said yarn threading portion of said spindle with said empty bobbin;

threading yarn guided by said yarn guide onto said yarn threading portion;

G. thereafter, commencing the traversee motion of the arm, and returning the arm to its normal traversing position; and H. after the threading operation is completed, returning the spindle with the empty bobbin to its normal winding position.

17. A method according to claim 16, wherein the direction of movement of the returning arm at the commencement of said returning step G is opposite to the direction of movement of the spindle with said empty bobbin returning to its normal winding position in step H.

18. A method for continuously winding a yarn in a yarn winding apparatus having two spindles rotatably and axially slidably disposed in parallel with each other and a threading arm disposed between said two spindles and having a yarn guide swingable in a plane perpendicular to said spindles, comprising the steps of:

A. feeding a yarn to one of said spindles to be wound thereon, while said spindle is axially traversed to and fro relative to said arm;

B. when a predetermined amount of yarn is wound on the spindle, swinging said arm toward an empty bobbin inserted onto the other spindle;

C. when the bobbins are changed, moving the spindle with said empty bobbin from a normal winding position to a threading position wherein the yarn guide mounted on the top of said arm corresponds to a yarn threading portion of said spindle and is stopped there while the spindle with a predetermined amount of wound yarn continues its traverse motion;

D. then swinging said arm toward said threading portion of said spindle with said empty bobbin;

E. threading the yarn guided by said yarn guide formed at the top of said arm onto said threading portion; and F. thereafter, commencing the traverse motion of said spindle with said empty bobbin, and returning said arm to the original position.

19. A method according to claim 16, 17 or 18, including the steps of: (1) traversing a yarn relative to a bobbin inserted onto a driven spindle; (2) winding the yarn on said bobbin so as to form a yarn layer; (3) measuring the thickness of the yarn layer; (4) gradually decreasing the traverse width as the yarn layer increases,; and (5) reversing the direction of the traverse motion when the amount of wound yarn corresponding to a distance from a predetermined position which is located within a traverse region becomes equal to the amount corresponding to a predetermined traverse width.

* * * * *